US009421560B2

(12) United States Patent
Conrad

(10) Patent No.: US 9,421,560 B2
(45) Date of Patent: Aug. 23, 2016

(54) METHOD AND APPARATUS TO DELIVER A FLUID MIXTURE

(75) Inventor: Wayne Ernest Conrad, Hampton (CA)

(73) Assignee: Omachron Intellectual Property Inc., Hampton, Ontario (CA)

( * ) Notice: Subject to any disclaimer, the term of this patent is extended or adjusted under 35 U.S.C. 154(b) by 856 days.

(21) Appl. No.: 13/552,113

(22) Filed: Jul. 18, 2012

(65) Prior Publication Data

US 2013/0020410 A1 Jan. 24, 2013

Related U.S. Application Data

(60) Provisional application No. 61/510,218, filed on Jul. 21, 2011.

(51) Int. Cl.

| | |
|---|---|
| ***B05B 7/04*** | (2006.01) |
| ***B05B 7/08*** | (2006.01) |
| ***B05B 7/16*** | (2006.01) |
| ***B05B 9/03*** | (2006.01) |
| ***B01F 15/02*** | (2006.01) |
| ***B01F 15/04*** | (2006.01) |
| ***B05B 7/14*** | (2006.01) |
| ***B05B 9/00*** | (2006.01) |
| ***B05B 9/04*** | (2006.01) |
| ***B05B 9/047*** | (2006.01) |
| ***B05B 12/14*** | (2006.01) |
| ***B05B 1/00*** | (2006.01) |
| ***B01F 13/00*** | (2006.01) |
| *B05B 12/12* | (2006.01) |
| *B05B 15/06* | (2006.01) |

(52) U.S. Cl.

CPC ..... *B05B 7/0408* (2013.01); *B01F 13/0027* (2013.01); *B01F 15/042* (2013.01); *B05B 1/005* (2013.01); *B05B 7/1418* (2013.01); *B05B 9/007* (2013.01); *B05B 9/04* (2013.01); *B05B 9/042* (2013.01); *B05B 9/047* (2013.01); *B05B 9/0413* (2013.01); *B05B 12/1418* (2013.01); *B05B 12/1445* (2013.01); *B05B 7/166* (2013.01); *B05B 7/1693* (2013.01); *B05B 12/124* (2013.01); *B05B 12/126* (2013.01); *B05B 15/066* (2013.01); *B05B 15/068* (2013.01)

(58) Field of Classification Search

CPC .... B05B 1/005; B05B 7/0408; B05B 7/1418; B05B 7/166; B05B 7/1693; B05B 9/007; B05B 9/04; B05B 9/0413; B05B 9/042; B05B 9/047; B05B 12/124; B05B 12/126; B05B 12/1418; B05B 12/1445; B05B 15/066; B05B 15/068; B01F 13/0027; B01F 15/042

See application file for complete search history.

(56) References Cited

U.S. PATENT DOCUMENTS

| | | | | |
|---|---|---|---|---|
| 3,708,123 | A * | 1/1973 | Krueger | 239/415 |
| 3,799,403 | A * | 3/1974 | Probst et al. | 222/135 |
| 6,533,189 | B2 * | 3/2003 | Kott et al. | 239/8 |
| 7,347,345 | B2 * | 3/2008 | Guerrero et al. | 222/148 |
| 2004/0217185 | A1 * | 11/2004 | Bien | 239/10 |
| 2008/0173728 | A1 * | 7/2008 | Ilfrey | 239/74 |
| 2013/0015262 | A1 * | 1/2013 | Monchamp et al. | 239/61 |

FOREIGN PATENT DOCUMENTS

GB 1430403 A 3/1976

* cited by examiner

*Primary Examiner* — Darren W Gorman

(74) *Attorney, Agent, or Firm* — Phillip C. Mendes da Costa; Bereskin & Parr LLP/S.E.N.C.R.L., s.r.l.

(57) ABSTRACT

An apparatus for conveying, and optionally mixing and conveying a building product such as a sealant, a mastic, paint or the like is provided.

17 Claims, 31 Drawing Sheets

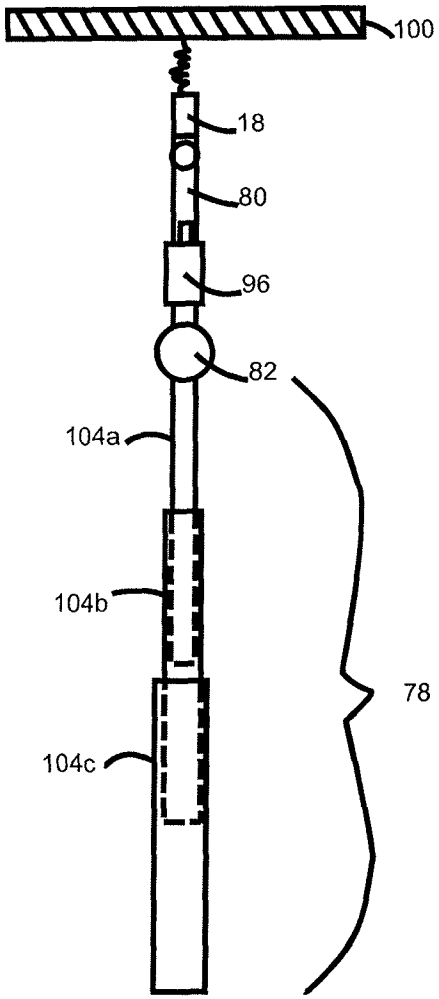
Figure 17
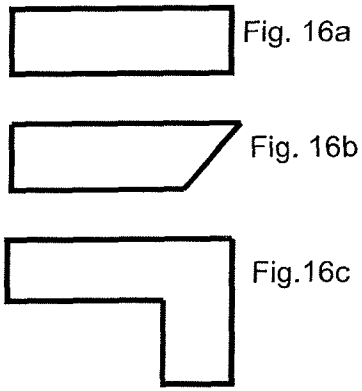
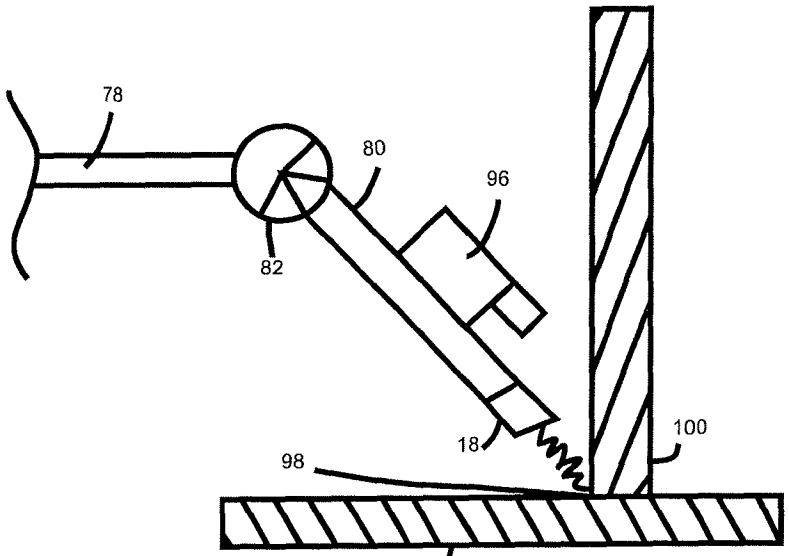
Figure 15

METHOD AND APPARATUS TO DELIVER A FLUID MIXTURE

This application claims priority from U.S. provisional application No. 61/510,218, the disclosure of which is incorporated herein in its entirety.

FIELD OF THE INVENTION

This invention relates to apparatus for delivering a fluid material (such as those used in construction and renovation including a mastic, an adhesive such as a masticated rubber, a caulking such as an acrylic latex, a sealant such as a two part foamable material, a sealant, insulation and the like) to a point of application for the purpose of sealing cracks, gaps and openings in the structure of, or ducting in, homes, commercial buildings and the like to reduce the infiltration of air, water or other substances. More preferably, this apparatus relates to a method for mixing at least two fluids and delivering the fluid material produced from the at least two fluids to a point of application.

BACKGROUND

Systems for mixing a two component system and applying the mixture are known. In such systems, each component is drawn from a container and fed through a pump and mixed in a hand held spray gun. Due to the use of the pumps, the apparatus is heavy and requires clean up after use. In particular, the pumps and conduits should be rinsed to flush the component therefrom to prevent fouling of the equipment.

SUMMARY

In accordance with this disclosure, an apparatus for mixing and applying a two component or multi component system is provided. In one aspect, external drive members, such as peristaltic pumps, which act on the outer surface of a flexible conduit, are utilized. One advantage of this design is that the drive member and most of the flow path of the components do not have to be cleaned after each use. For example, if a mixer nozzle is provided in a gun at the end of the flow path of the individual conduits, then only the mixer nozzle needs to be cleaned or replaced after each use. Accordingly, cleanup is substantially simplified and fouling of the equipment may be avoided.

In accordance with this aspect, there is provided a mixing and dispensing apparatus comprising:

(a) a flow path comprising at least two conduits, at least a portion of each of which is flexible, each conduit having an inlet end connectable to a source of fluid and an exit end;

(b) a drive member adapted to act externally on the flexible portions;

(c) the flow path further comprising a mixer downstream from the exit ends and in fluid communication therewith;

(d) a discharge mechanism comprising a nozzle downstream from the mixer and in fluid communication therewith whereby the nozzle comprises a portion of the flow path and a hand grip portion wherein the hand grip portion is useable to direct the nozzle at a target surface whereby the fluids, once mixed, may be applied to the target surface; and, (e) a first actuator operatively connected to the drive member.

In one embodiment, the drive member may comprise at least one peristaltic pump.

In another embodiment, the actuator may be provided on the discharge mechanism proximate a handle.

In another embodiment, the apparatus further comprises an inlet port connectable to a source of pressurized gas and in flow communication with the flow path, whereby, when a source of pressurized gas is attached to the inlet port, the pressurized gas is useable to assist in driving fluid through the flow path and out the nozzle. The source of fluid may comprise at least two containers and an inlet port connectable to a source of pressurized gas is provided on at least one of the containers. Alternately, or in addition, the inlet port may be provided upstream of the mixer and a second actuator may be operable to cause gas to flow through the mixer when the flow of fluid therethrough has ceased, whereby mixed fluid is removed from the mixer and nozzle.

In another embodiment, the discharge mechanism further comprises a gas flow line having an inlet end connectable with a source of pressurized gas and an outlet end, and a second actuator is operable to cause gas to flow through the gas flow line whereby the target surface maybe cleaned before application of the mixed fluid.

In another embodiment, the apparatus further comprises a back flow preventer upstream of the mixer. The back flow preventer may be provided between the exit ends and the mixer.

In another embodiment, the mixer may be a static mixer.

In another embodiment, each of the at least two conduits has a different internal diameter. The fluids may be mixed in a particular ratio and the internal diameters may be dimensioned based on the ratio in which the fluids are to be delivered to the mixer.

In another embodiment, the drive member comprises a first driver to act externally on the flexible portion of one conduit and a second driver to act externally on the flexible portion of a second flexible and the drive members operate at different speeds. The different speeds may be selected so that the desired proportions of the fluids are delivered to the mixer.

In another embodiment, each conduit is connectable in fluid communication with a different pressurizable container and a member for applying different pressures to each pressurizable container may be provided. The different pressures may be selected so that the desired proportions of the fluids are delivered to the mixer.

In another embodiment, the source of fluid comprises at least two containers and the apparatus further comprises a weigh scale for each container wherein the weigh scale is operatively connected to the drive member whereby the drive member is adjustable so that the desired proportions of the fluids are delivered to the mixer.

In another embodiment, the apparatus further comprises a heating member provided along at least a portion of the flow path. The heating member may comprise a heated passage through which a portion of the flow path extends and/or a resistive heating member.

In another embodiment, the source of fluid comprises collapsible containers.

In another embodiment, the drive member comprises a drive portion operative connected to the flow path and a drive motor, the source of fluid comprises containers and the apparatus further comprises a first housing for receiving containers of the fluid, a portion of the flow path extending from the containers towards the mixer and the drive portion, the first housing has an openable lid. The first housing may be insulated. A second housing containing the drive motor may be provided. The second housing may be positioned with respect to the first housing such that the drive motor has a portion that extends from the second housing into the first housing and is drivingly engaged with the drive portion.

In accordance with this aspect, there is provided a pressurizable container comprising an openable rigid wall container, an interior volume for receiving a fluid container at least a portion of which is flexible, an inlet port connectable with a source of compressed fluid and an outlet in communication with the volume.

In one embodiment, the pressurizable container further comprises two openable compartments and each compartment is operable at a different pressure.

In another embodiment, the pressurizable container further comprises a heating member.

In accordance with this aspect, there is also provided a pressurizable container comprising a fluid container at least a portion of which is flexible, a fluid outlet and an inlet port connectable with a source of compressed fluid and an outlet in communication with an expandable member provided in the fluid container.

In accordance with this aspect, there is also provided a first fluid container for a first fluid and a second fluid container for a second fluid, at least a portion of at least one of the fluid containers is flexible, each fluid container having a fluid outlet, and an inlet port connectable with a source of compressed fluid and an outlet in communication with one of the fluid containers. The pressurizable container may further comprise a heating member. Each fluid container may be operable at a different pressure.

In accordance with another aspect, pressure may be applied to the container for the fluid or fluids that are used. This pressure may provide part or all of the motive force to cause the fluid to flow through the apparatus. For example, the fluid may be provided in a pressurizable container. Various designs for pressurizable containers may be used. The pressurized gas may be applied directly to the head space of a container, to an expandable balloon or the like provided in a container, to the interior cavity of a container that has one or more flexible containers therein, or to drive an internal piston or the like. Accordingly, for example, as pressurized gas is applied to the head space of a container, the pressure in the head space will cause fluid to be driven from the container.

In a preferred embodiment, both a pressurized fluid and an external drive member are utilized. Each may apply 10-90% of the motive force. Preferably, one provided 25-75% of the motive force and the other provides 75-25% of the motive force. More preferably, each provides about 50% of the motive force.

In some cases, the components require mixing in other than a 1:1 ratio. Different mixing ratios maybe achieved by utilizing different diameter conduits, a gear box or the like to adjust the relative rate of rotation of an external drive member that utilizes a single drive motor, utilizing different motors operating at different speeds, applying different pressures to the storage containers or a combination thereof.

In accordance with another aspect, one or more of the fluids may be heated such as by heating the storage container or the conduit through which the fluid flows.

In accordance with another aspect, a telescoping and/or articulated delivery wand maybe utilized. A camera and/or a distance sensor may be provided to assist in applying the product produced by the apparatus.

In accordance with another aspect, an apparatus may be designed to apply a single component system. In such a case, only a single storage container is required. Such an apparatus may utilize any of the features disclosed herein.

It will be appreciated that a method and apparatus in accordance with this disclosure may use any one or more of these aspects.

DRAWINGS

In the detailed description, reference will be made to the following drawings, in which:

FIG. 15 is a schematic view of an articulated wand according to another embodiment;

Figure 19:
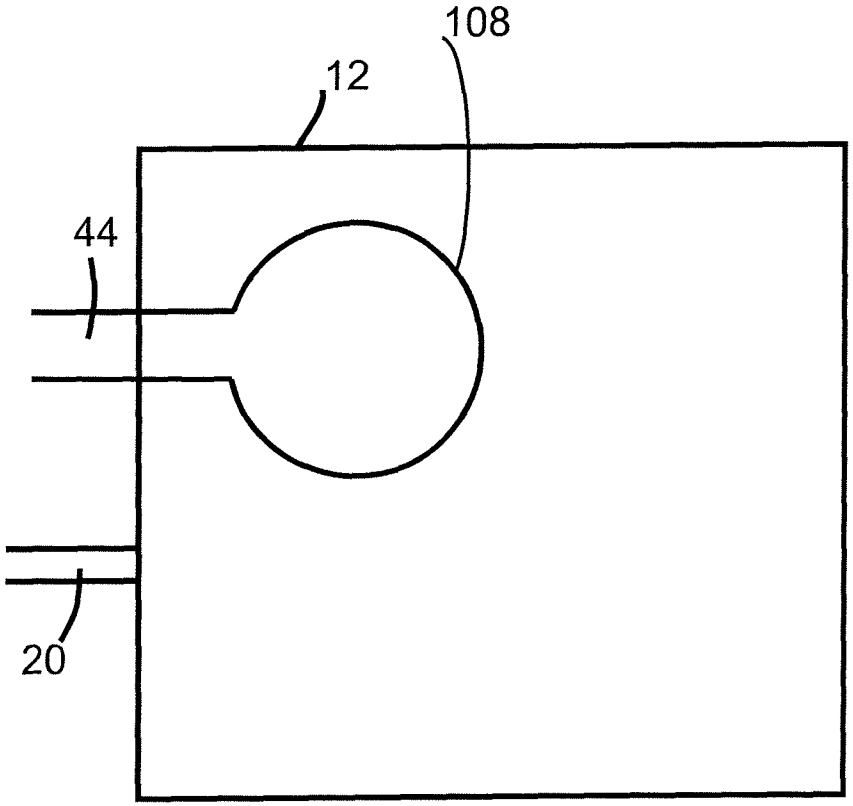
Figure 18:
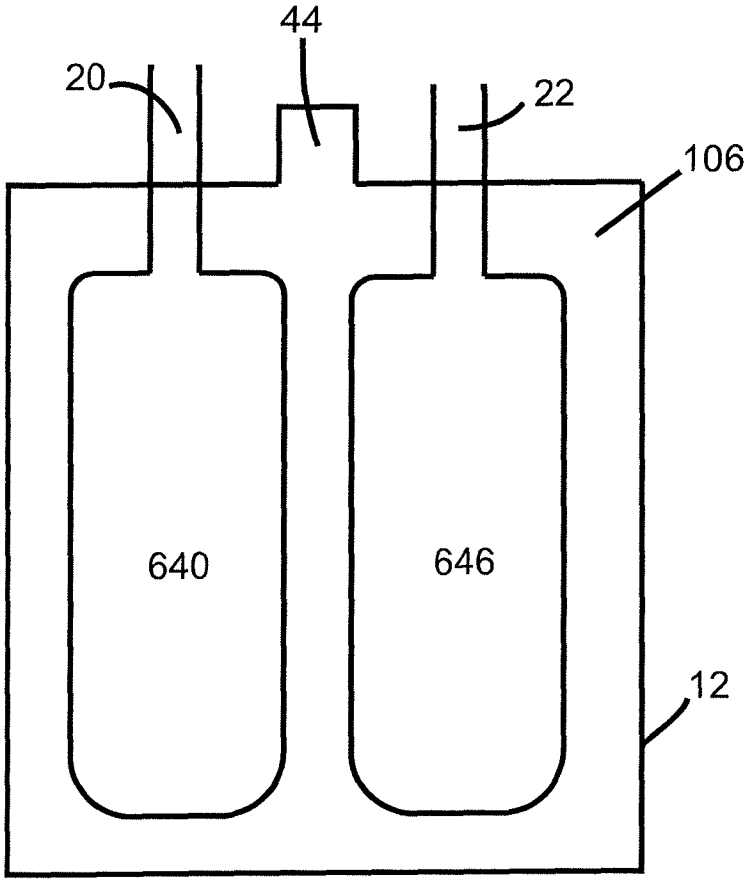
Figure 20:
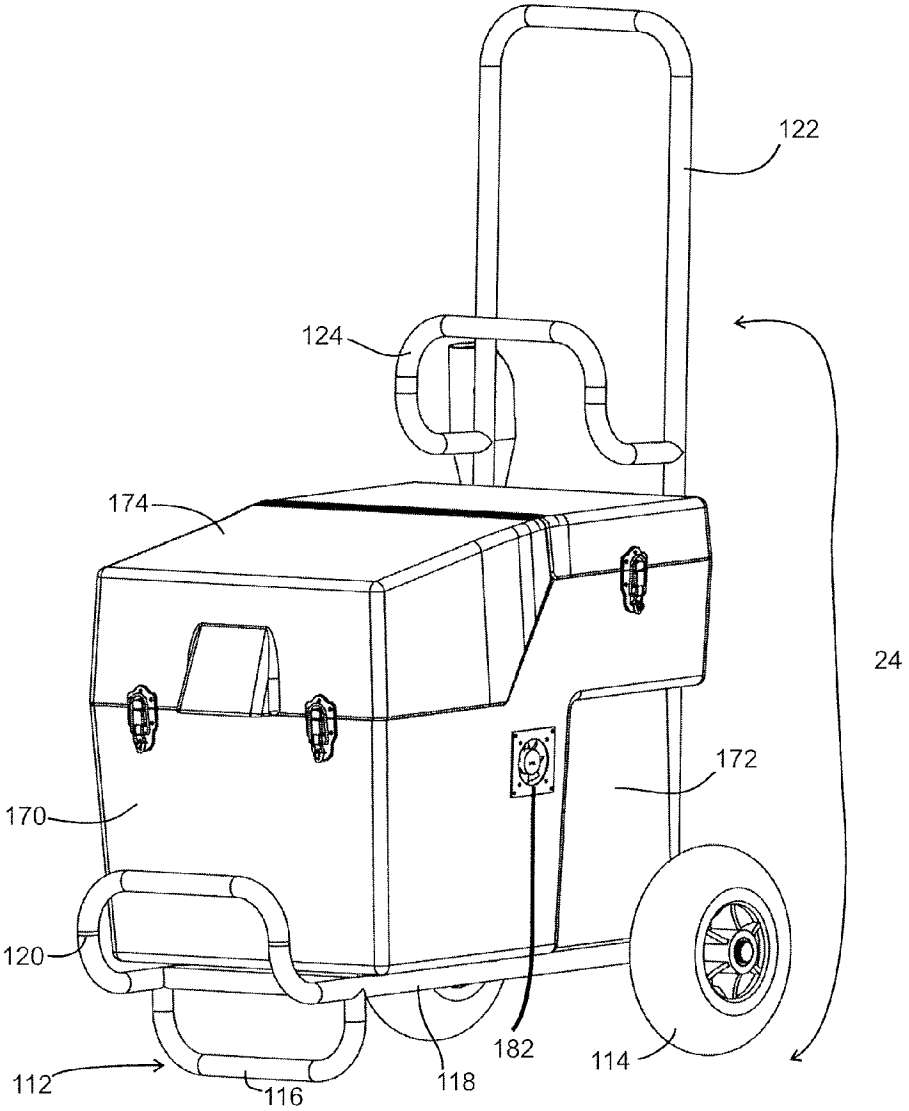
Figure 21:
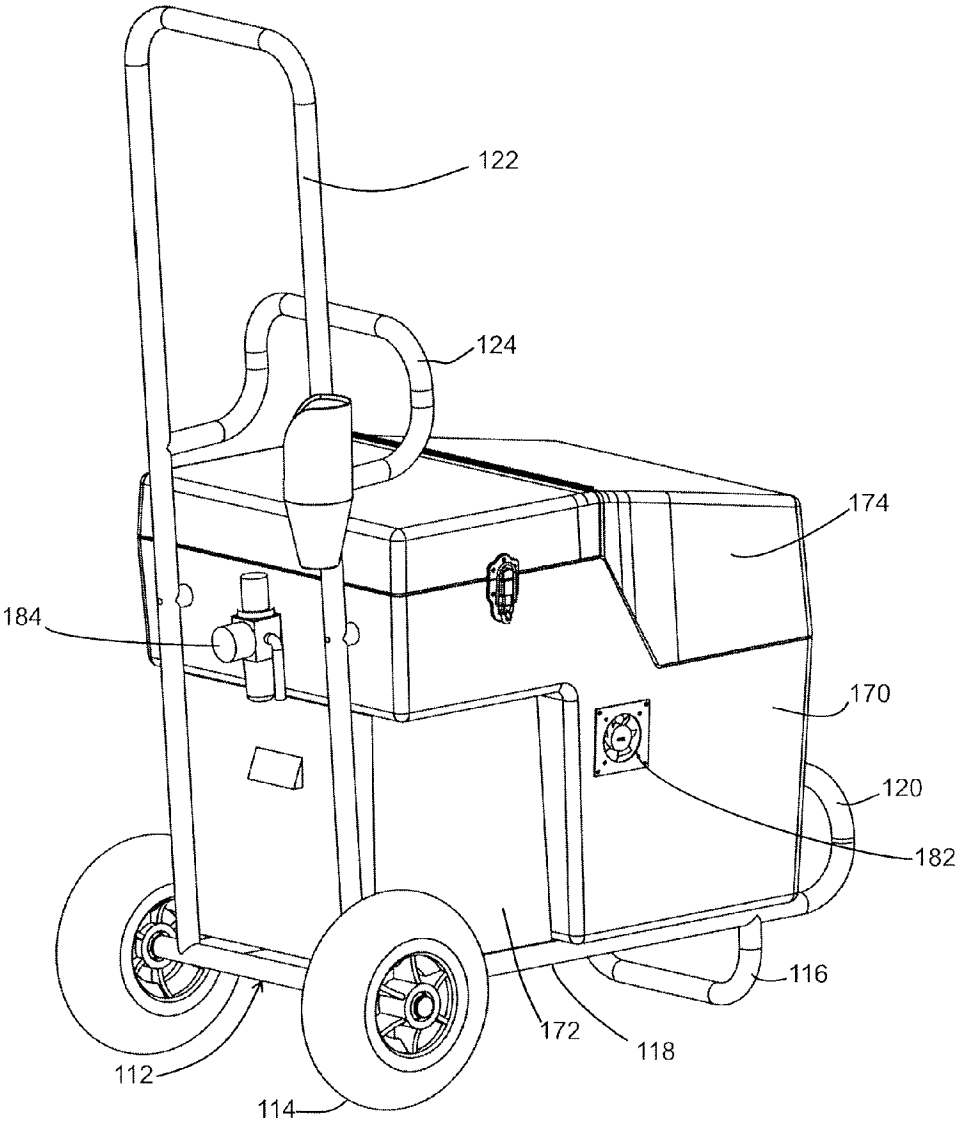
Figure 22:
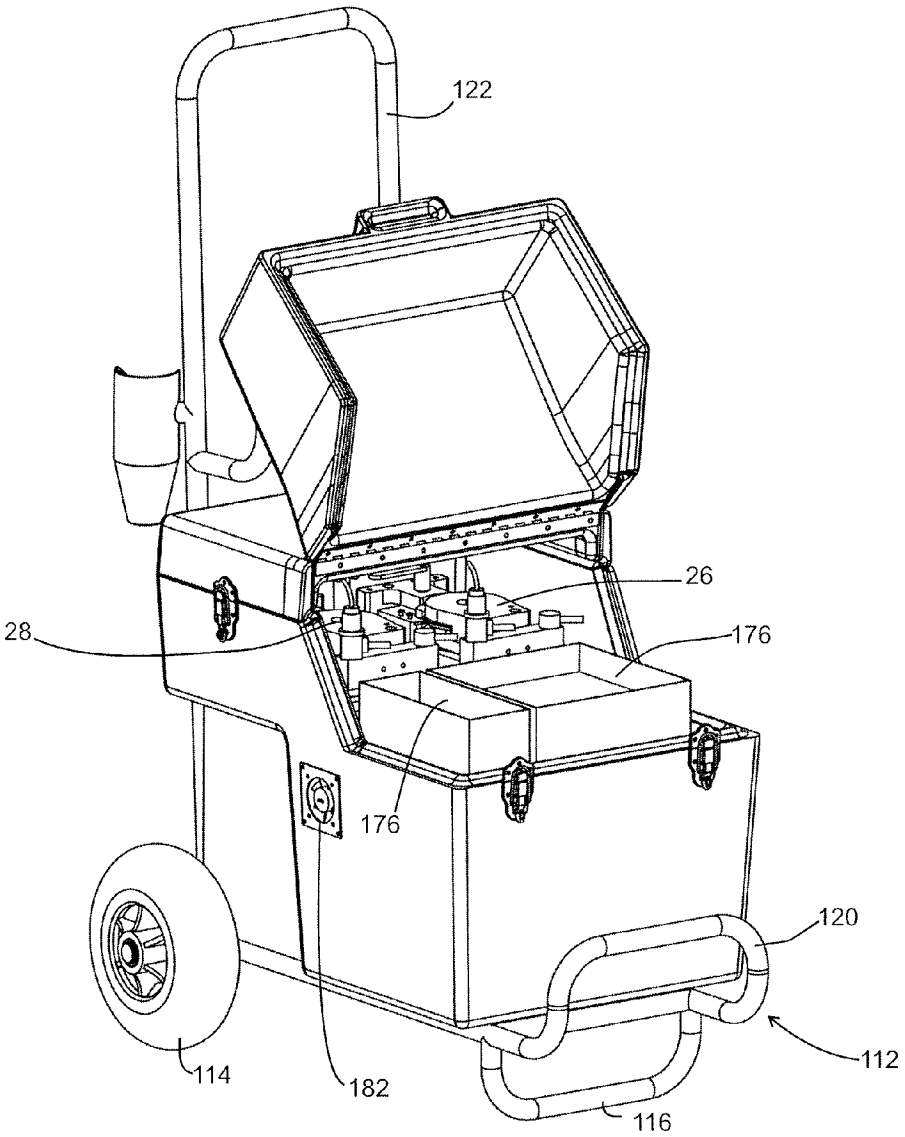
Figure 23:
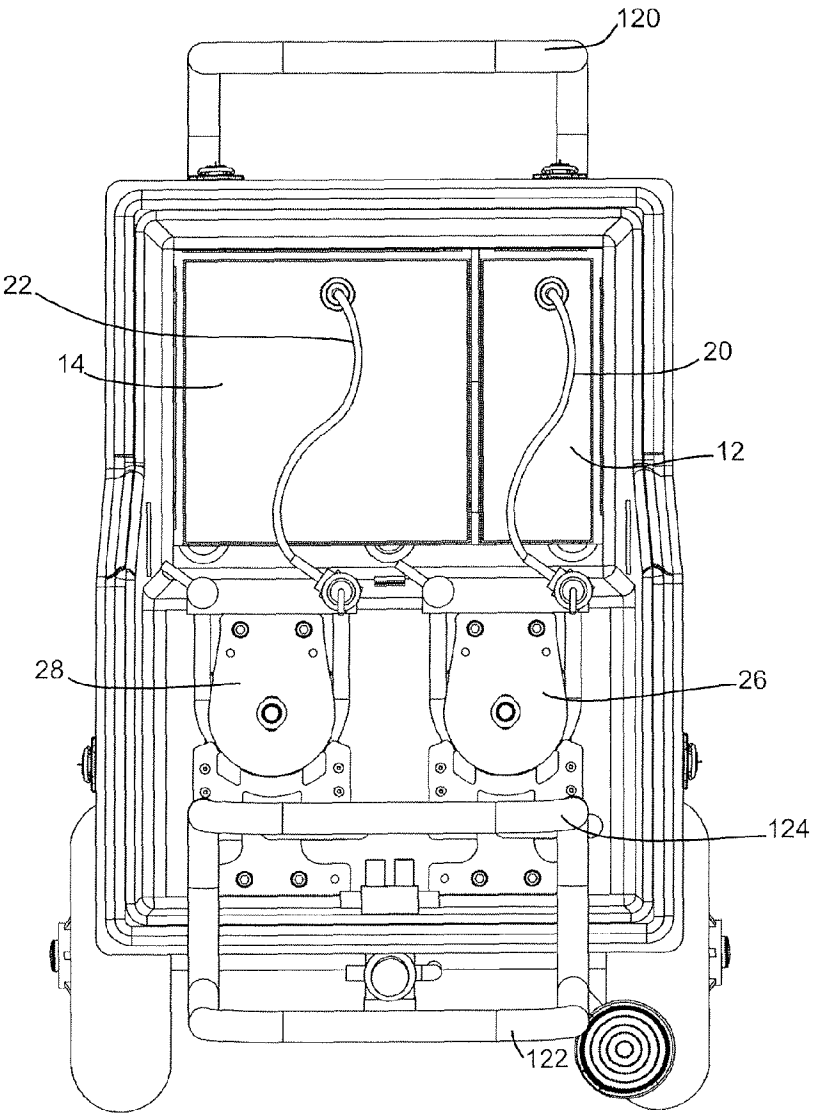
Figure 24:
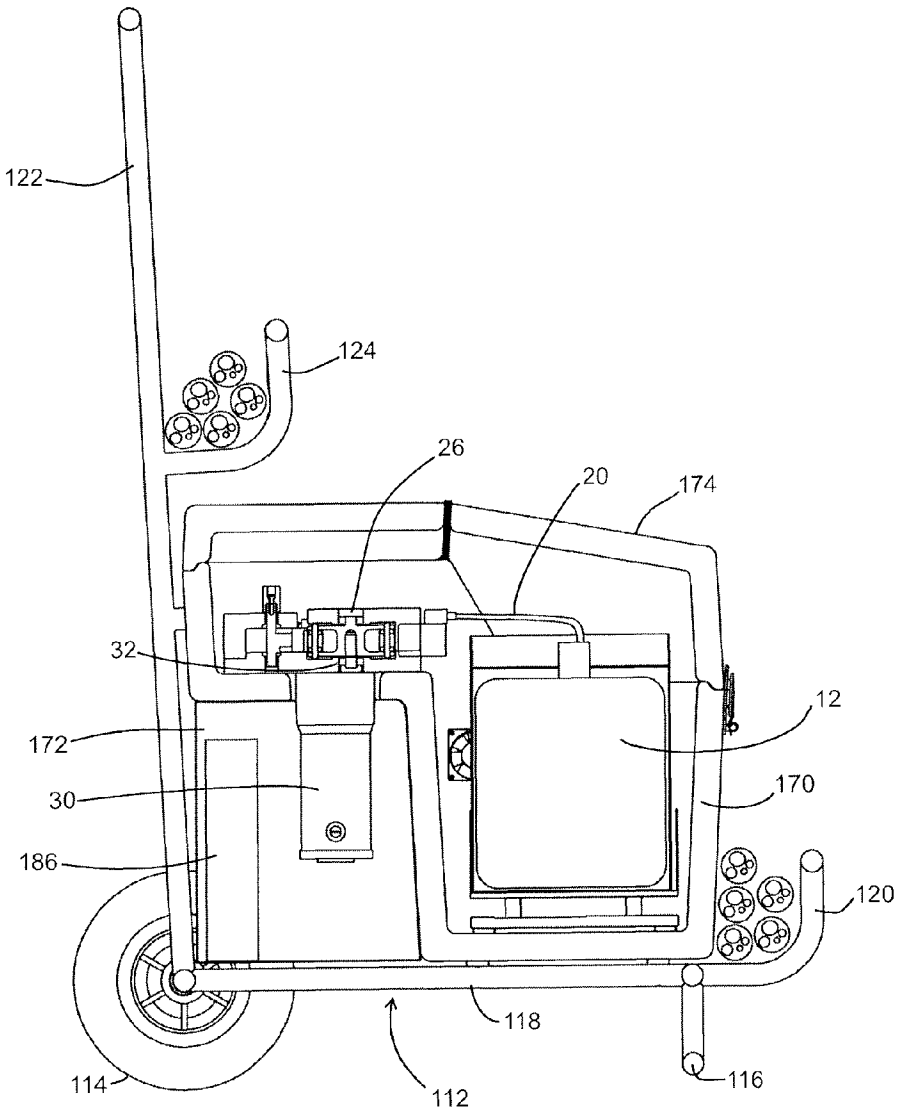
Figure 25:
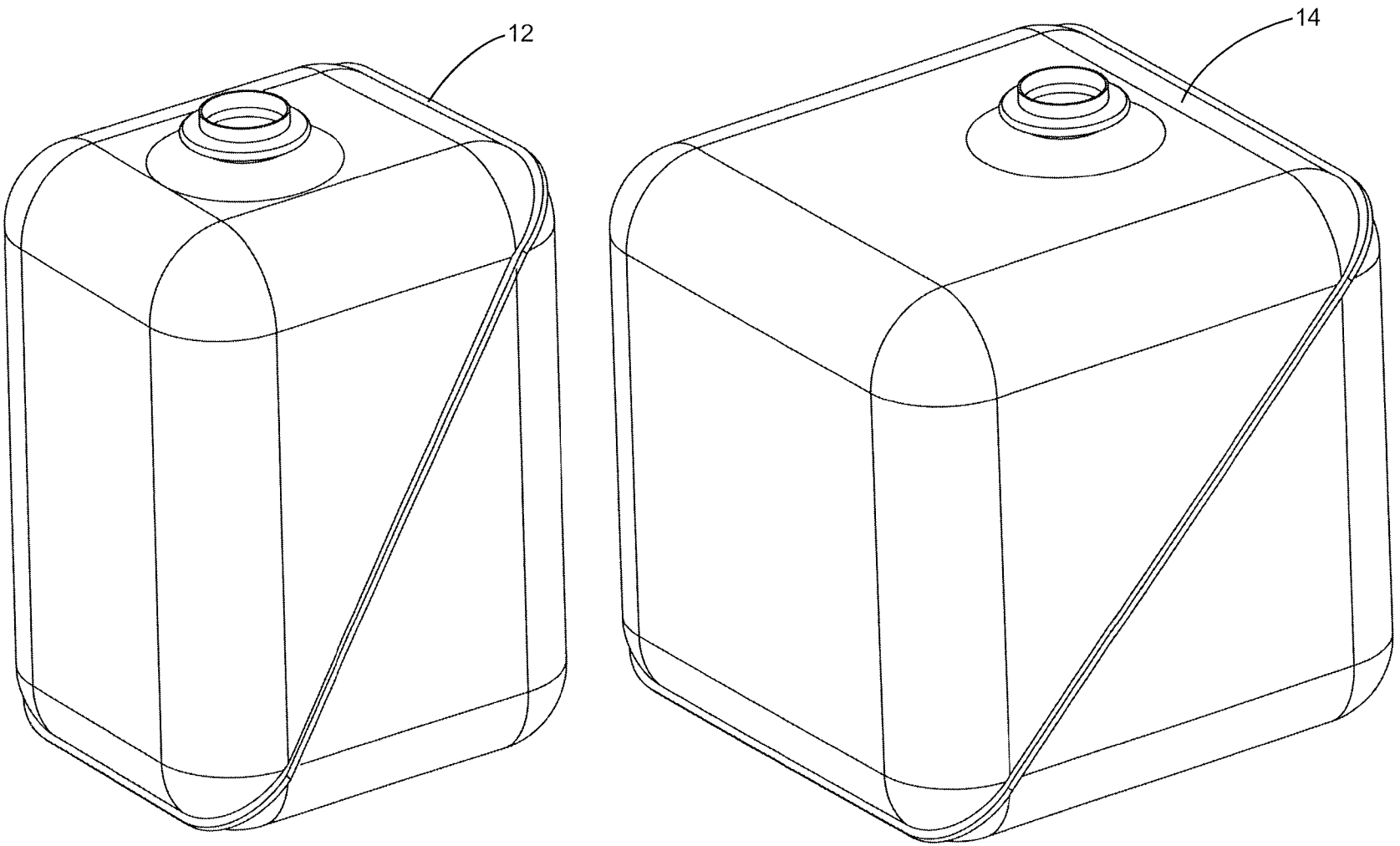
Figure 26:
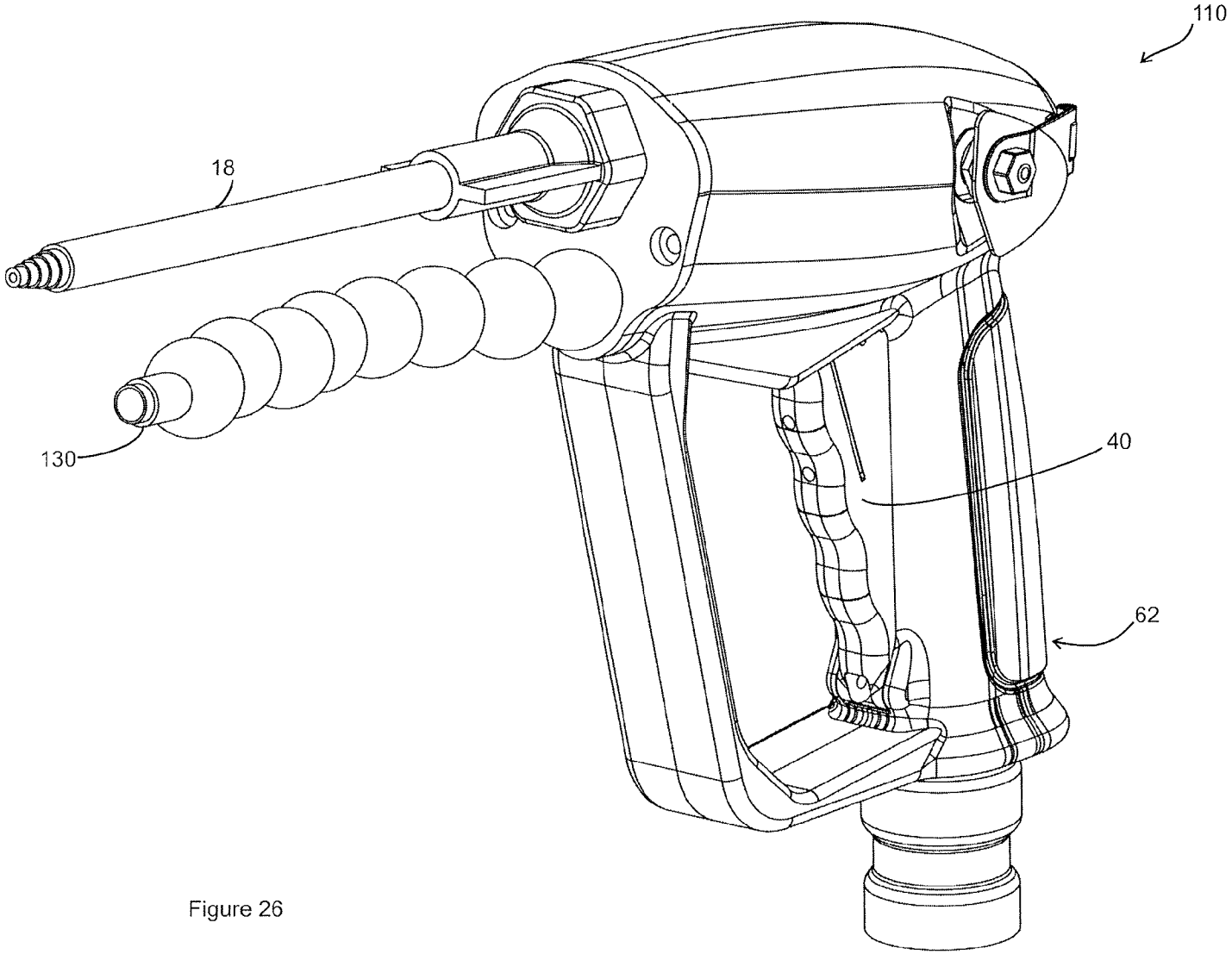
Figure 27:
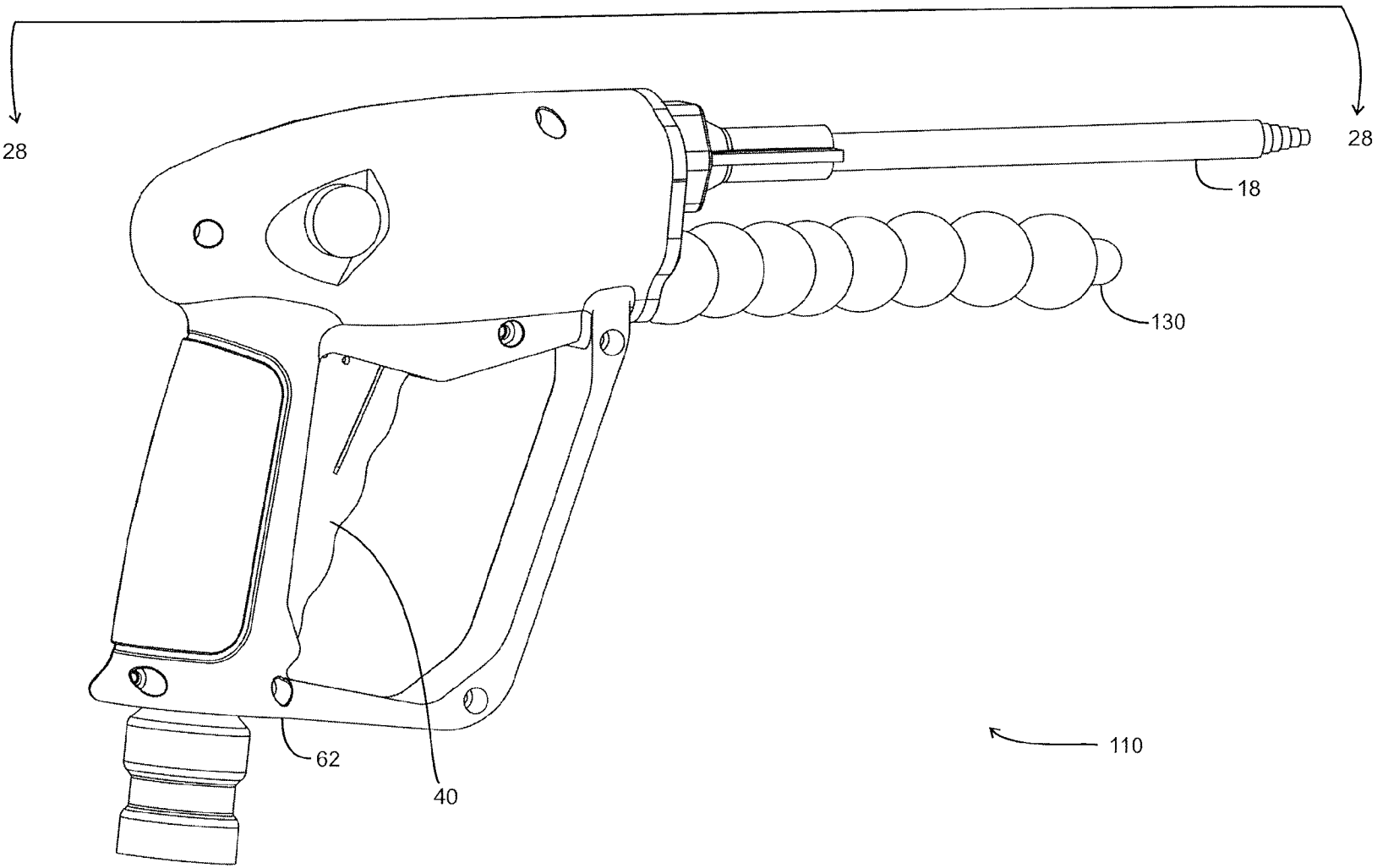
Figure 28:
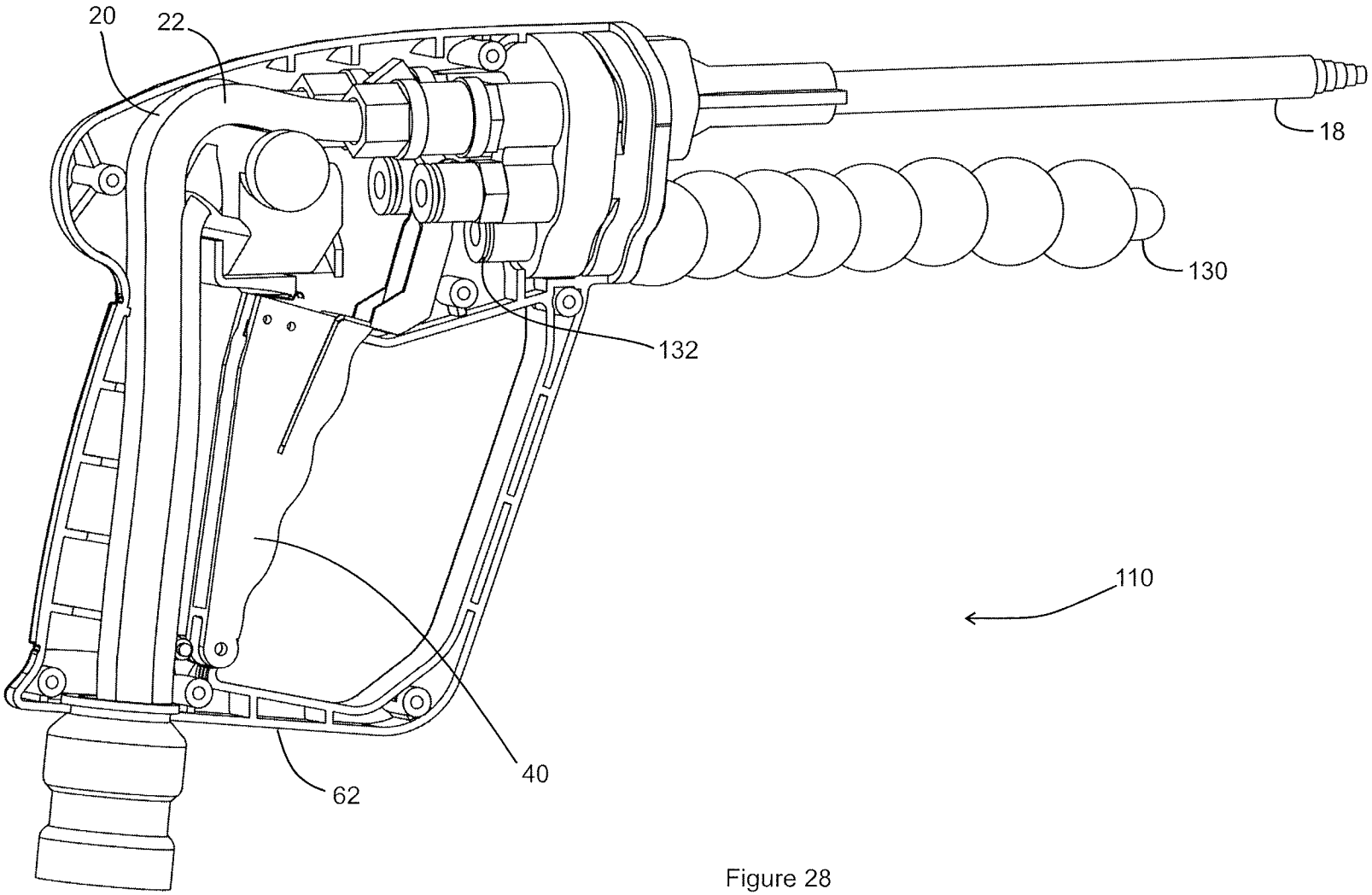
Figure 29:
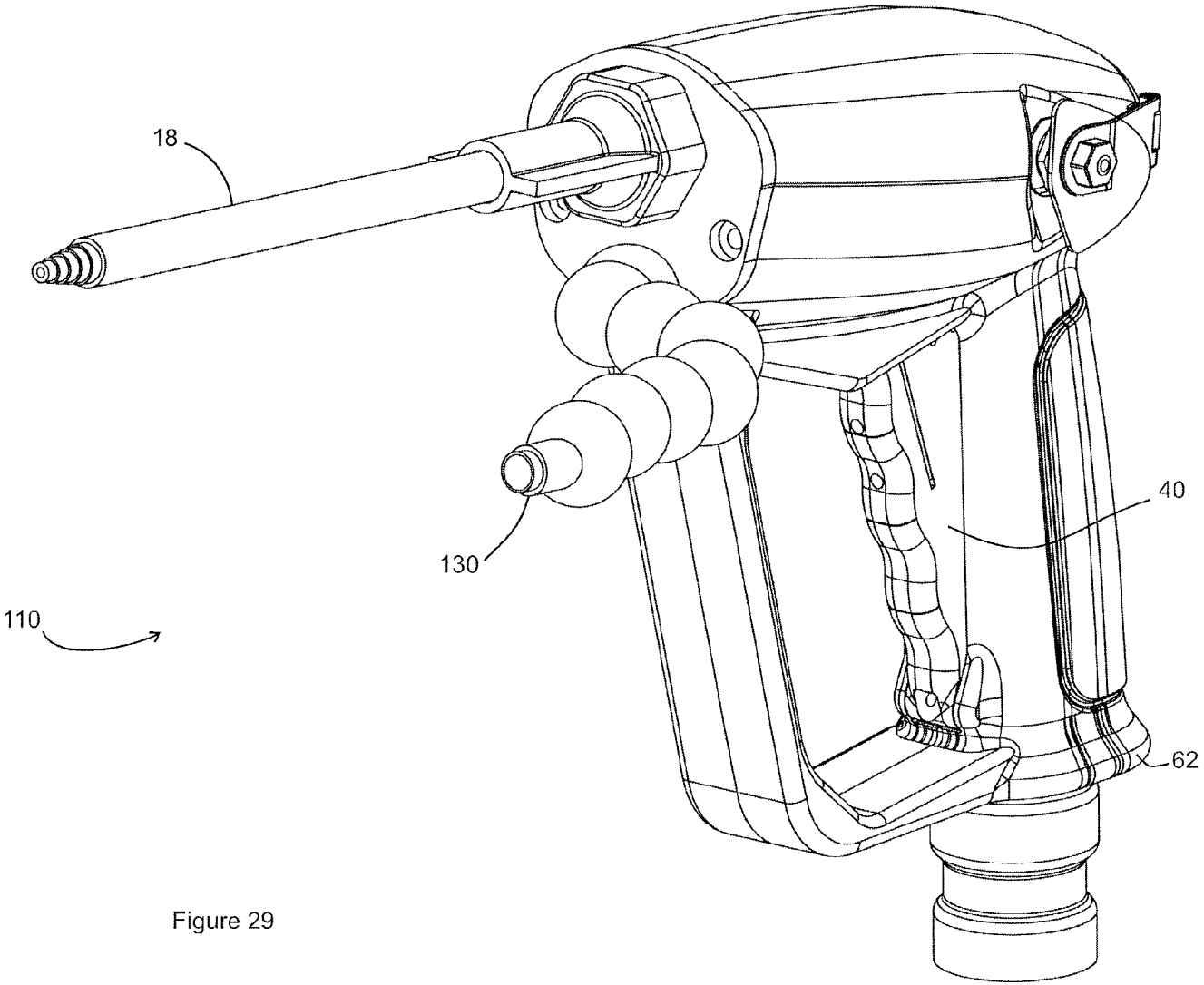
Figure 30:
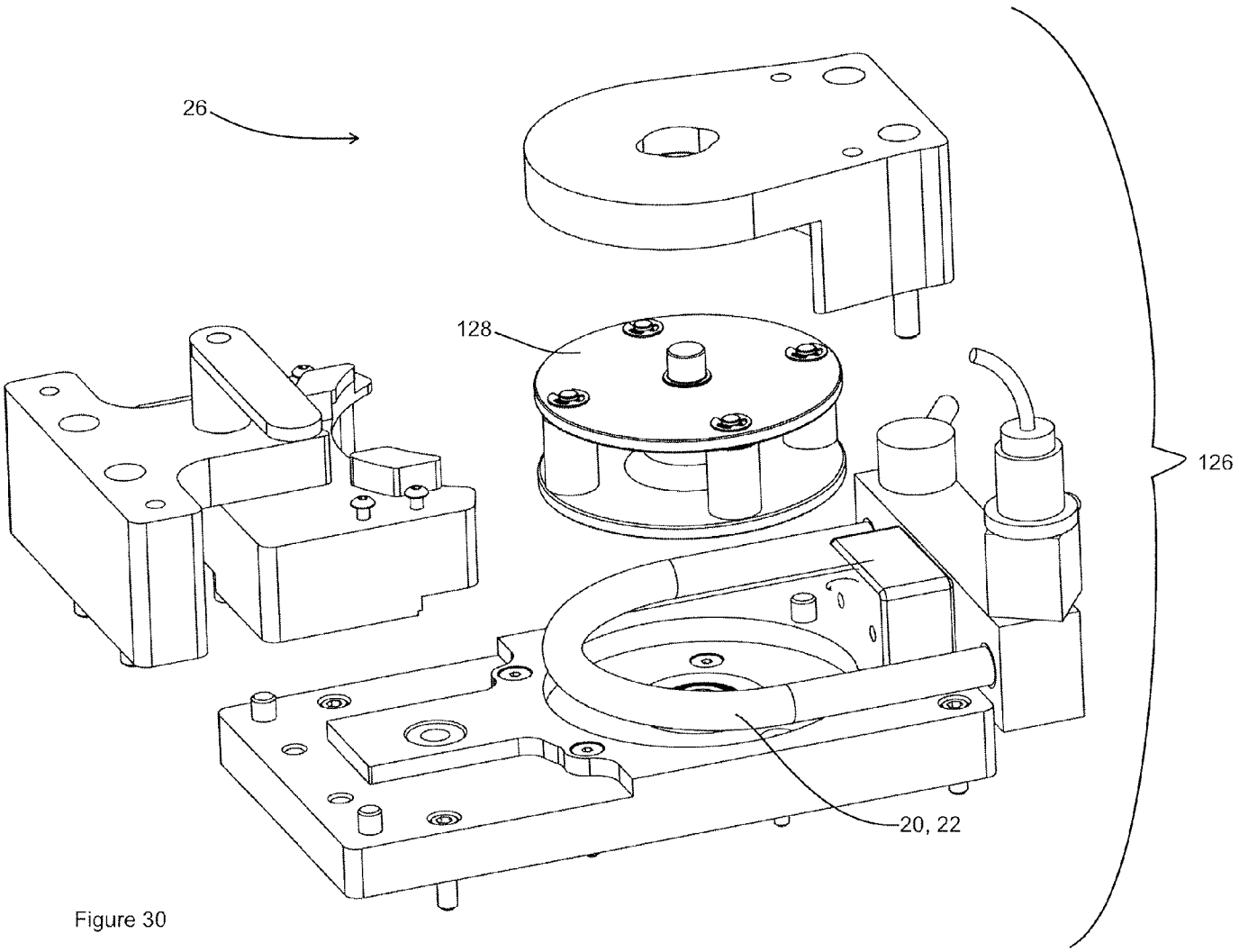
Figure 31:
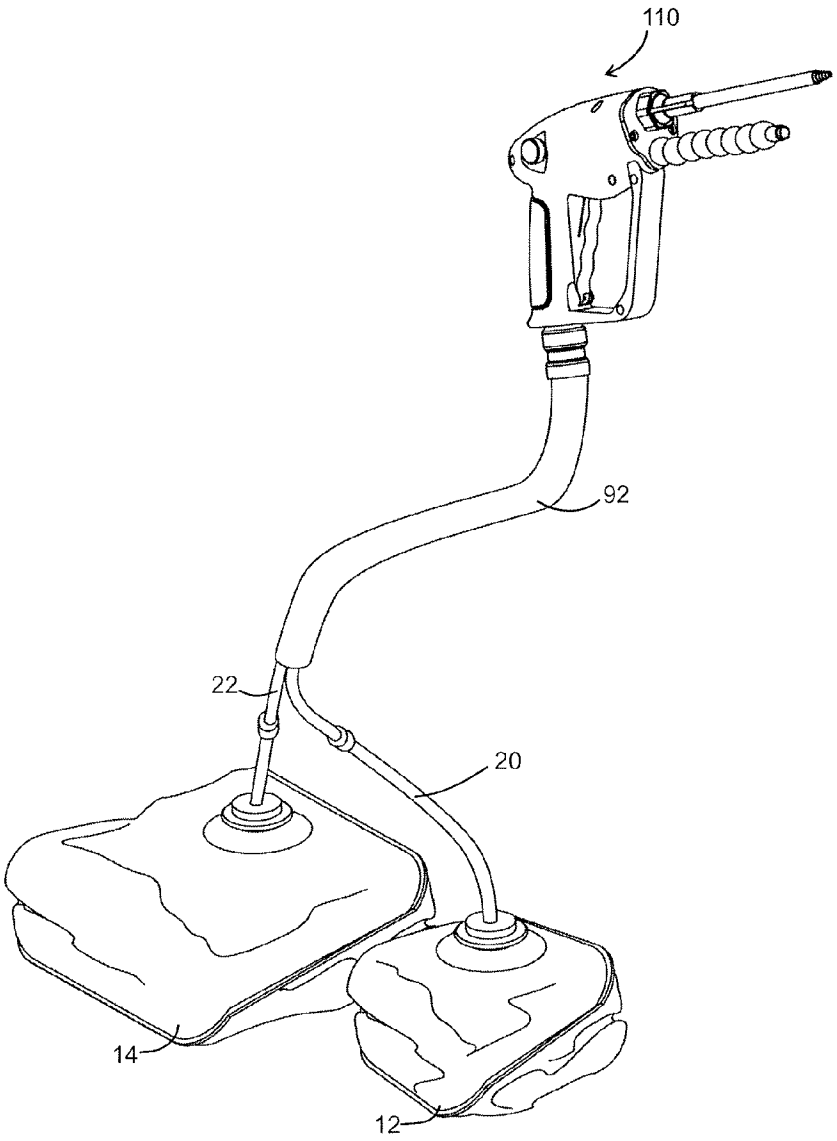
Figure 32:
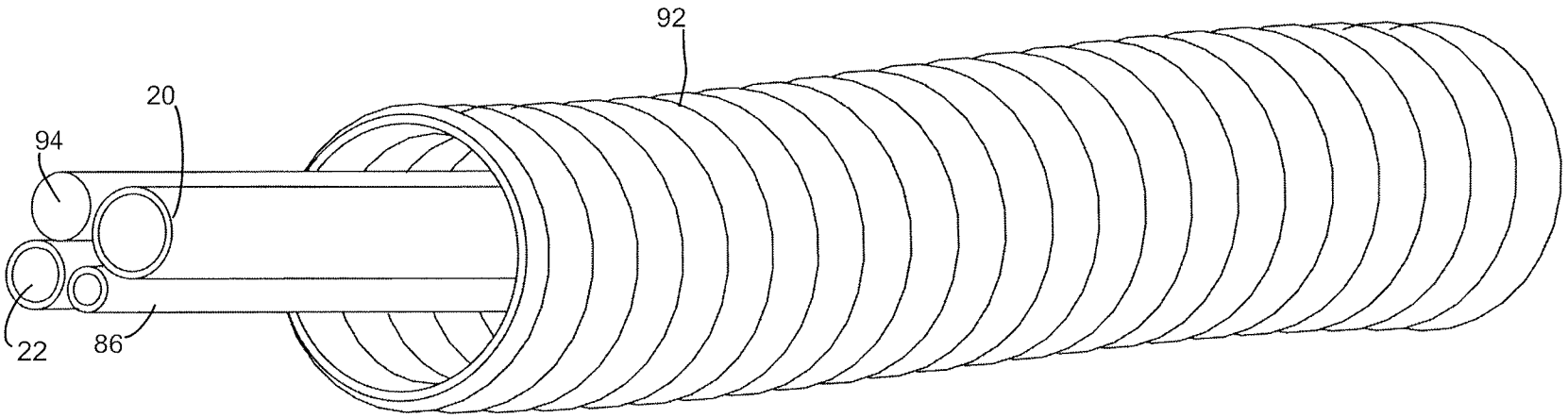
Figure 33:
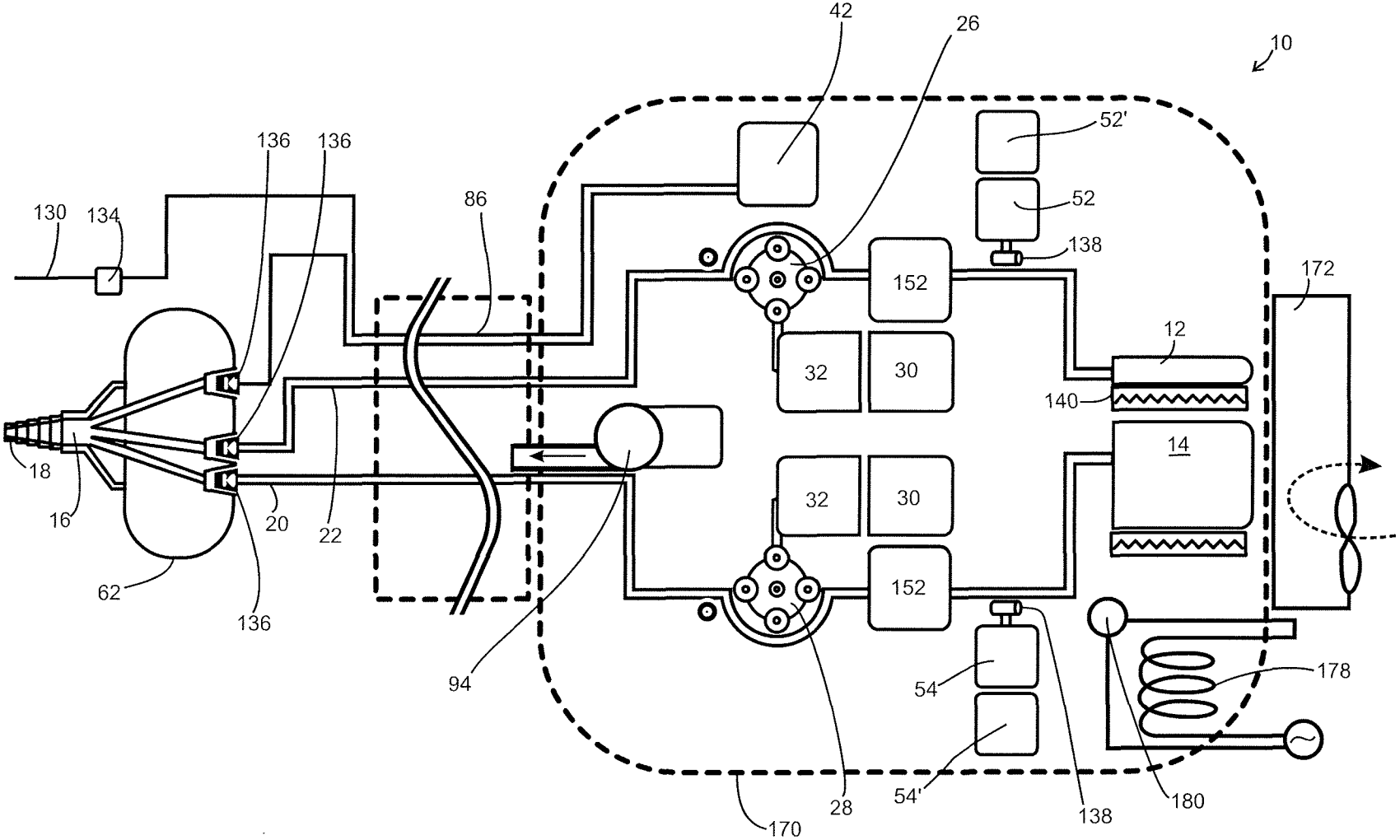
Figure 34:
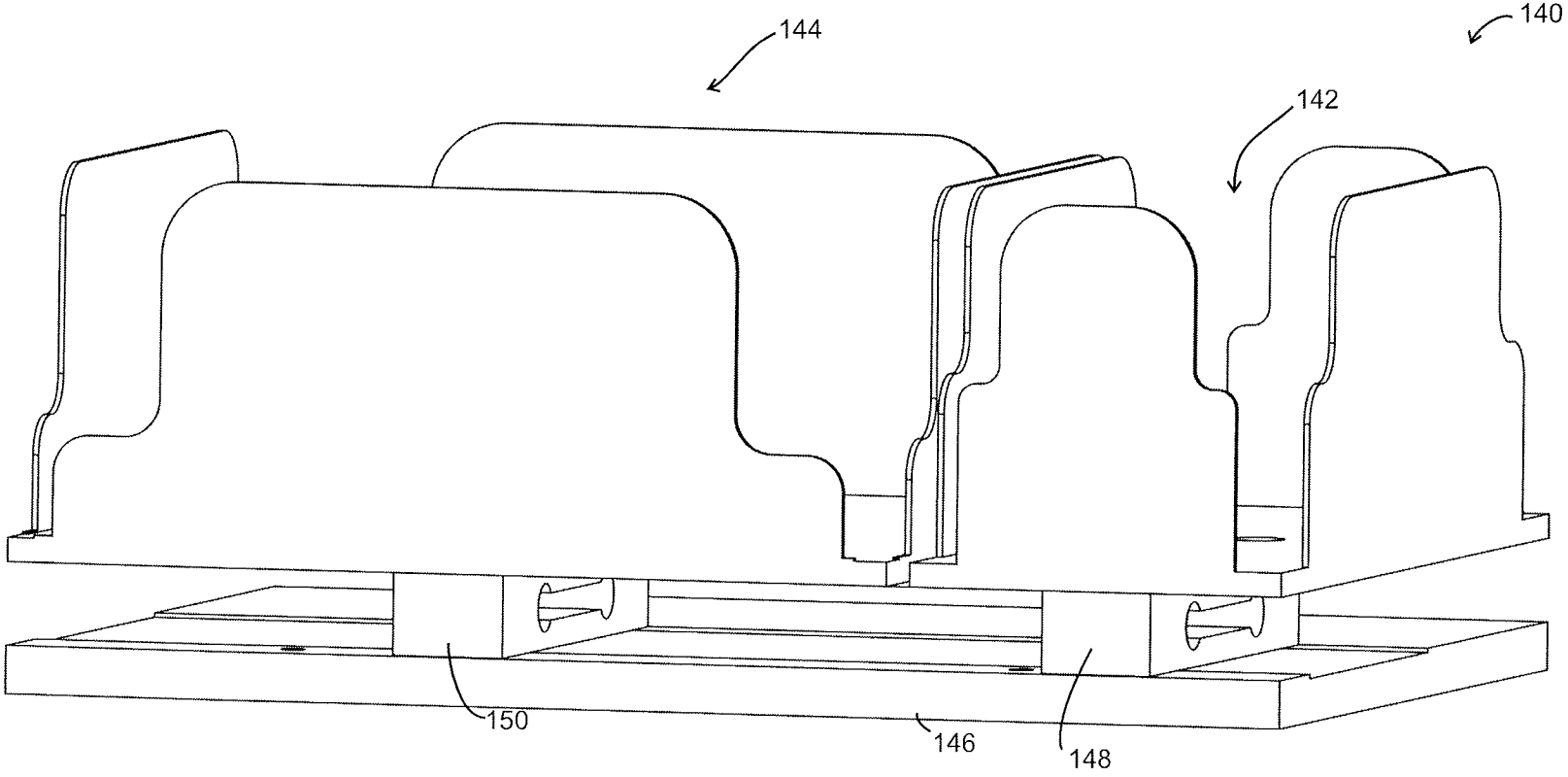

FIGS. 16*a*-16*c* are alternate embodiments of optional nozzles;

FIG. 17 is a schematic view of an telescoping wand according to another embodiment;

FIG. 18 is a schematic drawing of a pressurizable container according to another embodiment;

FIG. 19 is a schematic drawing of a pressurizable container according to another embodiment;

FIG. 20 is a perspective view from the front of a particular embodiment of the apparatus;

FIG. 21 is a perspective view from the rear of the apparatus of FIG. 20;

FIG. 22 is a perspective view from the front of the apparatus of FIG. 20 with the lid open;

FIG. 23 is a top plan view of the apparatus of FIG. 20 with the upper portion of the housing removed;

FIG. 24 is a cross-section along the line 24-24 in FIG. 20;

FIG. 25 is a perspective view of pressurizable containers that may be used with the apparatus;

FIG. 26 is a perspective view from the front of an optional gun that may be used with the apparatus;

FIG. 27 is a perspective view from the rear of the gun of FIG. 26;

FIG. 28 is a cross-section along the line 28-28 in FIG. 27;

FIG. 29 is a perspective view from the front of the gun of FIG. 26 with the flexible blow off nozzle oriented in a different direction;

FIG. 30 is an exploded view of an exemplary peristaltic pump;

FIG. 31 is a simplified drawing of the apparatus showing the collapsible containers, the applicator gun and the flexible conduits extending between the collapsible containers and the applicator gun with the housing and drive mechanism removed;

FIG. 32 is an exemplary hose bundle that may be used;

FIG. 33 is a schematic drawing of an alternate apparatus according to another embodiment;

FIG. 34 is a perspective view of a weigh scale that may be used in any embodiment; and, FIGS. 35-38 are schematic drawings of alternate fluid containers which utilizes a piston to drive fluid from the container.

DESCRIPTION OF VARIOUS EMBODIMENTS

Various processes and apparatus will be described below to provide an example of each claimed invention. No process or apparatus described below limits any claimed invention and any claimed invention may cover processes and apparatus that are not described below. The claimed inventions are not limited to processes and apparatus having all the features of any one process or apparatus, or to features common to multiple or all of the processes or apparatus described below. It is possible that a process or apparatus described below is not an embodiment of any claimed invention.

Figure 1:
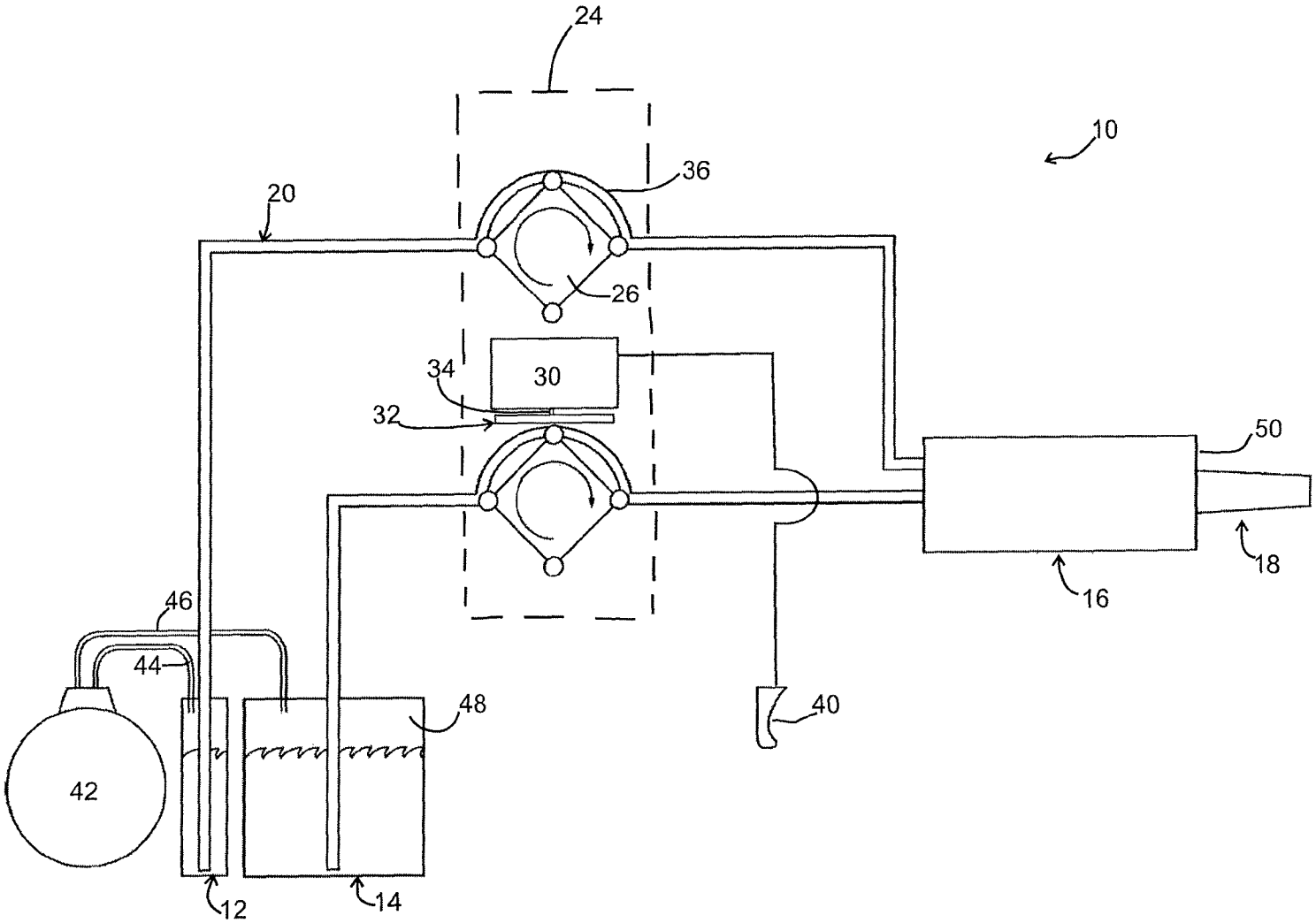
FIG. 1 is a schematic drawing of an apparatus according to one embodiment.

Referring to FIG. 1, an exemplary delivery and mixing apparatus is exemplified. As shown therein, the delivery apparatus comprises first and second pressurizable containers 12, 14 (see for example FIG. 25), a mixer 16, a nozzle 18, first and second conduits 20 and 22, each of which extends between a respective pressurizable container 12, 14 and mixer 16, and a drive member 24. Accordingly, fluids contained in pressurizable containers 12, 14 may be conveyed through conduits 20, 22 to mixer 16, wherein the fluids are mixed, and then dispensed through a nozzle 18.

It will be appreciated that nozzle 18 may be provided at the downstream end of downstream extension wand 80 or gun 110 (see for example FIGS. 26-29) or at another location spaced from mixer 16. As exemplified in FIG. 16*a*, nozzle 18 may have an outlet that is transverse to the longitudinal length of nozzle 18. As exemplified in FIG. 16*b*, nozzle 18 may have an outlet that is at an angle to the longitudinal length of nozzle 18. As exemplified in FIG. 16*c*, nozzle 18 may have an outlet that is parallel to the longitudinal length of nozzle 18.

Figure 6:
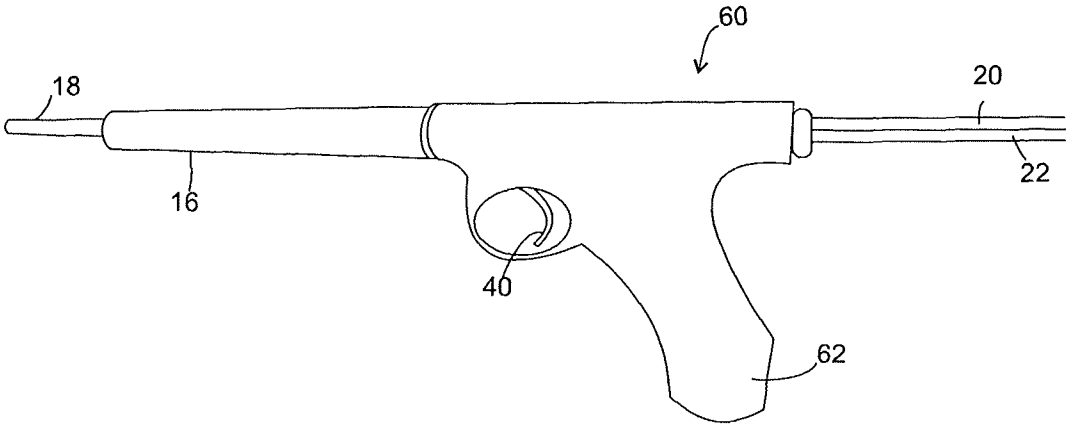
FIG. 6 is a side view of a support structure according to one embodiment.
Figure 7:
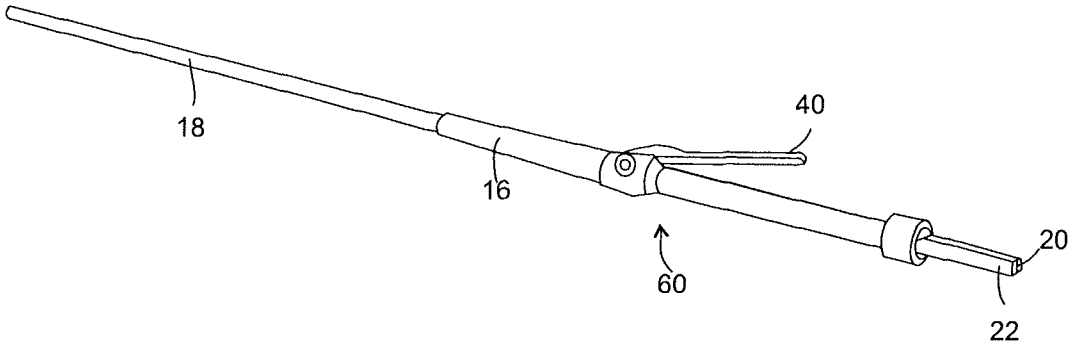
FIG. 7 is a perspective view of an alternate support structure.

Each fluid container may hold, e.g. from 1-2 liters of fluid up to, e.g., 20-25 liters of fluid. Accordingly, the containers may be relatively light and could be portable, e.g., carried in a hand-held caddy or worn on a back pack. The conduits, or at least a portion thereof, are preferably flexible, (e.g., flexible plastic tubing) in which case a support structure, such as exemplified in FIGS. 6 and 7, is preferably provided to house an actuator and enable a user to control the location at which the material produced from the mixed fluids is deposited. Accordingly, it will be appreciated that the entire apparatus may be portable. For example, a user may transport the pressurizable containers 12, 14 by hand carrying or wearing a back pack with the containers to a location where the material is to be applied. In such a case, a relatively short length of conduit (e.g., 1 to 20 feet, more preferable 3 to 12 feet and most preferably 4 to 8 feet) may be provided. Alternately, if the fluid containers are large, they may be positioned at a location and a sufficient length of conduit 20, 22 may be provided (e.g., 10 to 50 feet) to enable a user to treat a particular area. In such a case, all of the apparatus other than the containers 12, 14 may be portable. Alternately, as exemplified in FIGS. 20-24, the apparatus may be mounted on a caddy 112 so it may be wheeled to a desired location.

Caddy 112 may be of any design that will hold the apparatus. As exemplified, caddy 112 has rear wheels 114, a front support 116 that is provided at or towards the front of horizontal support frame 118. It will be appreciated that one or more wheels may be provided on or in lieu of front support 116. A front bumper 120 may be provided. Bumper 120 may also assist in retaining the apparatus on caddy 112 during movement of caddy 112. A handle 122 may be provided to assist in moving caddy 112. Preferably, the caddy is provided with a mount 124 for the conduit 20, 22, which may be a wrap. As exemplified in FIG. 24, conduit 20, 22 may be looped over mount 124. Alternately, or in addition, conduit 20, 22 may be immediately behind front bumper 120 as exemplified in FIG. 24.

The fluids in pressurizable containers 12 and 14 may be any compounds utilized in the building arts. For example, the fluid in one of containers 12, 14 may be a mastic, a caulking, an adhesive, a sealant or other building product. The fluid in the other of containers 12, 14 may be a blowing agent, or, if the building product is produced from mixing two components, the second component. For example, one container 12, 14 may contain a polymeric methyl diphenol diisocyanate (PMDI) and the other container 12, 14 may contain mixed polyols, a blowing agent such as HFC 245fa, a catalyst, a surfactant and optionally flame retardants. Accordingly, when the fluids are combined in mixer 16 a spray foam insulation is produced. Another example would be to provide an acrylic latex, a polyacylic acid, surfactants, and stabilizer in one container 12, 14 and a plasticizer, a cross linking agent, and a solid base blowing agent in the other container 14. Accordingly, when the fluids are combined in mixer 16 an acrylic spray foam material would be produced. Another example includes a two component paint. In some embodiments, a single container 12, 14 may be utilized. In such a case, the single container 12, 14 may contain a single material for caulking consisting of acrylic latex, a filler such as calcium carbonate, surfactant and optional colorant or a one component paint to provide a protective, functional, and/or decorative finish to surfaces.

It will be appreciated that the material produced by the apparatus may be produced by mixing three or more fluids together. In such a case, apparatus 10 may be adapted to include more than two containers 12, 14. For example, one conduit 20, 22 may be provided for each fluid that is to be delivered to mixer 16. Alternately, some or all of the fluids may be introduced to each other upstream of mixer 16. For example, the conduits may include a "Y" joint to combine the conduits into a single conduit upstream of mixer 16. Preferably, as exemplified in FIG. 28, the conduits 20 and 22 have exit ends that are connected directly to the mixer.

As exemplified in FIG. 1, drive member 24 utilizes first and second peristaltic pumps 26, 28 which are driven by a motor 30. Any peristaltic pump known in the arts may be used. As exemplified in FIG. 30, peristaltic pump 26 comprises a base 126 to which rotating drive 128 is mounted. A conduit 20, 22 may be wound around the rotating drive 128. When rotating drive 128 rotates, fluid is pumped through conduit 20, 22.

In order to permit first and second peristaltic pumps 26, 28 to operate at different speeds, motor 30 may be drivingly connected to one of the peristaltic pumps 26, 28 by shaft 34 and optional gear box 32. Accordingly, when motor 30 is operated, peristaltic pump 26 may be driven directly by motor 30 (e.g., a shaft may extend between motor 30 and the pump 26) to operate at a first speed. Peristaltic pump 28 may be driven via gear box 32 so as to operate at an alternate speed.

It will be appreciated that, in an alternate embodiment, a gear box 32 may be provided between motor 30 and each of peristaltic pumps 26, 28. The gear boxes 32 may be the same or different so that the pumps 26, 28 may operate at the same or different speeds. Gear box 32 may provide a fixed gearing or may provide a variable gearing so as to enable a user to adjust the speed of one or both of peristaltic pumps 26, 28. It will be appreciated that, in an alternate embodiment, two motors of different speeds may be employed to drive each of the peristaltic pumps 26, 28 to provide the desired mix ratio between the materials in containers 12, 14.

An advantage of using a peristaltic pump is that the pump operates externally on conduits 20, 22. It will be appreciated that at least portions 36, 38 of conduits 20, 22 are flexible so that fluid therein is moved along the conduit as peristaltic pumps 26, 28 rotate. It will be appreciated that all of conduits 20, 22 may be flexible (see for example FIG. 31). Further, peristaltic pumps 26, 28 may be rotary peristaltic pumps as exemplified or, alternately they may be linear peristaltic pumps. Other external drive members which may be utilized include stepper motors, servo motors, gear motors, axial flux motors, air pressure or compressed gas driven motors, hydraulic motors and internal or external combustion engines.

An advantage of using a peristaltic pump is that the fluids which are being conveyed do not travel through the pump. Accordingly, no clean-up of the pump is required after use of apparatus 10. This is particularly advantageous if, for example, a sticky or tacky compound such as an adhesive or mastic is applied via apparatus 10. In operation, apparatus 10 may be cleaned up by replacing conduits 20, 22 and washing or blowing out mixer 16 and nozzle 18. Alternately, mixer 16 and nozzle 18 may also be replaced. In addition, pressurizable containers 12, 14 may be refillable or may be replaceable. Alternately, mixer 16 and nozzle 18 may be cleaned out by passing a gas therethrough after use, such as by using air line 86 as discussed subsequently.

A further advantage of the peristaltic system is that a back flow preventer or check valve is not needed for plural-component systems. When the peristaltic pump is in a stationary position, the pump may compress the conduit 20, 22 thereby preventing back flow and accordingly operating as a check valve.

It will be appreciated that one or more other back flow preventing means may be utilized. For example, a check valve 136 or the like may be provided immediately upstream of mixer 16 so as to prevent mixed fluid entering each line leading to mixer 16.

As exemplified in FIG. 1, an actuator (e.g. trigger 40) is provided. Trigger 40 as exemplified is operatively connected to motor 30. For example, trigger 40 may close a contact so as to complete a circuit to actuate motor 30. Optionally, trigger 40 may be operatively connected to motor 30 so as to provide a variable level of power to motor 30. Accordingly, for example, the more actuator 40 is depressed, the more power may be provided to motor 30 and therefore the faster peristaltic pumps 26, 28 may operate.

Optionally, as exemplified in FIG. 1, a pressure source 42 is provided in flow communication with first and second pressurizable containers 12, 14 via first and second pressure lines 44 and 46. Accordingly, a pressurized gas may be provided to the head space 48 in containers 12 and 14 so as to assist in driving fluid out of containers 12, 14 and into conduits 20 and 22. Accordingly, the motive force to drive the fluid through conduits 20, 22 to and through mixer 16 may comprise both drive member 24 and pressure source 42.

The pressure source may be a source of compressed gas (e.g. a disposable canister of compressed gas or a refillable canister of compressed gas, e.g. carbon dioxide). Alternately, the pressure source may be a compressor, which may be operated by connection to an electrical grid or by a battery pack or a small internal or external combustion engine, or a small fuel cell. A similar member may be used to operate motor 30.

It will be appreciated that a separate pressure source 42 may be provided for each container 12, 14. Alternately, or in addition, pressure lines 44, 46 may have the same internal diameter or different internal diameters. Alternately or in addition, valves 56, 58, which may be separable controllable may be provided (see for example FIG. 5). Accordingly, differential pressures may be applied to each container 12, 14 or as to provide a different motive force. This may be utilized if one of the fluids is more viscous and/or the fluids are to be mixed other than in a 1:1 ratio.

Mixer 16 may be of various designs, and, preferably, is a static mixer. Accordingly, mixer 16 need not have any moving parts. Instead, the fluids in conduits 20, 22 may be mixed as they pass through a non-linear path in nozzle 16. For example, nozzle 16 may include an internal helical member so as to define a helical path through which the fluids pass as they travel through mixer 16 and are thereby mixed. Other examples of mixtures which may be utilized include a rotating dynamic mixer comprised of one or more rotating Archimedean screws or a lobed mixer.

As exemplified, nozzle 18 is preferably provided on downstream end 50 of mixer 16. Accordingly, nozzle 18 may be a one-piece assembly with mixer 16. Accordingly, mixer 16 and nozzle 18 may be a single unit which can be washed, blown out or disposed of.

Figure 2:
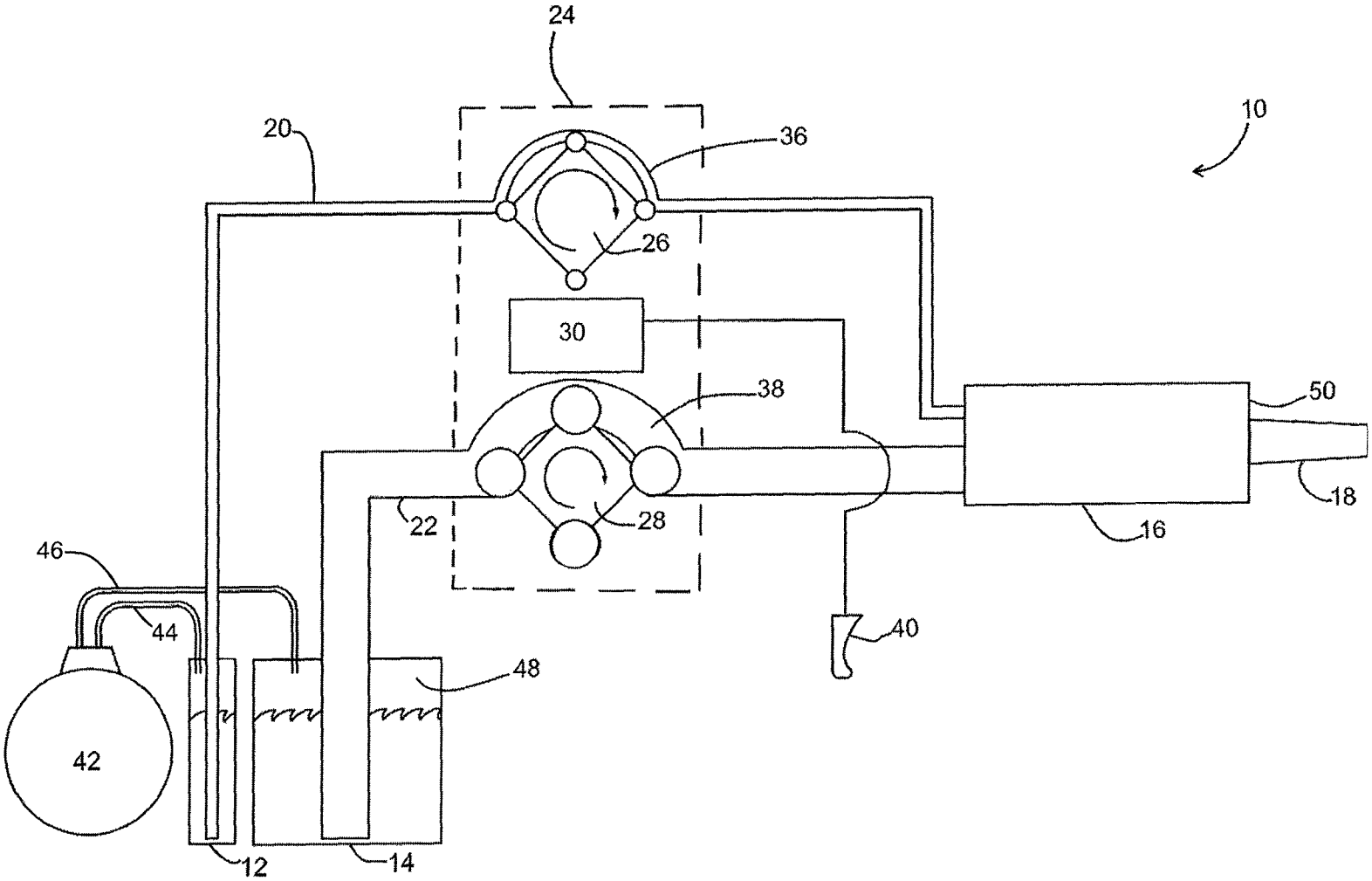
FIG. 2 is a schematic drawing of an alternate apparatus according to another embodiment.

An alternate embodiment is exemplified in FIG. 2. In this embodiment, conduit 22 has a larger internal diameter than conduit 20. Accordingly, if peristaltic pumps 26, 28 rotate at the same speed, then a greater quantity of fluid will be drawn through conduit 22 as compared to conduit 20. Accordingly, it will be appreciated that by adjusting the internal diameter of conduits 20 and 22, different proportions of fluids may be drawn from containers 12, 14 and mixed. Accordingly, instead of utilizing a gear box 32 to adjust the relative rate of rotation of peristaltic pumps 26, 28, the desired mixing ratio of the fluids in containers 12 and 14 may be adjusted merely by utilizing different diameters for conduits 20 and 22. Alternately, or in addition, different flow rates of the fluids may be achieved by applying different pressures to head space 48 of containers 12 and 14. Accordingly, by applying a larger pressure in the head space of container 14 than compared with container 12, a greater amount of fluid may be drawn through conduit 22. Accordingly, in order to adjust the mixing ratio of the fluids in containers 12 and 14, apparatus 10 may use a combination of one or more of differential pressures in containers 12 and 14, different rates of rotation of peristaltic pumps 26, 28, different internal diameters of conduits 20 and 22.

Figure 3:
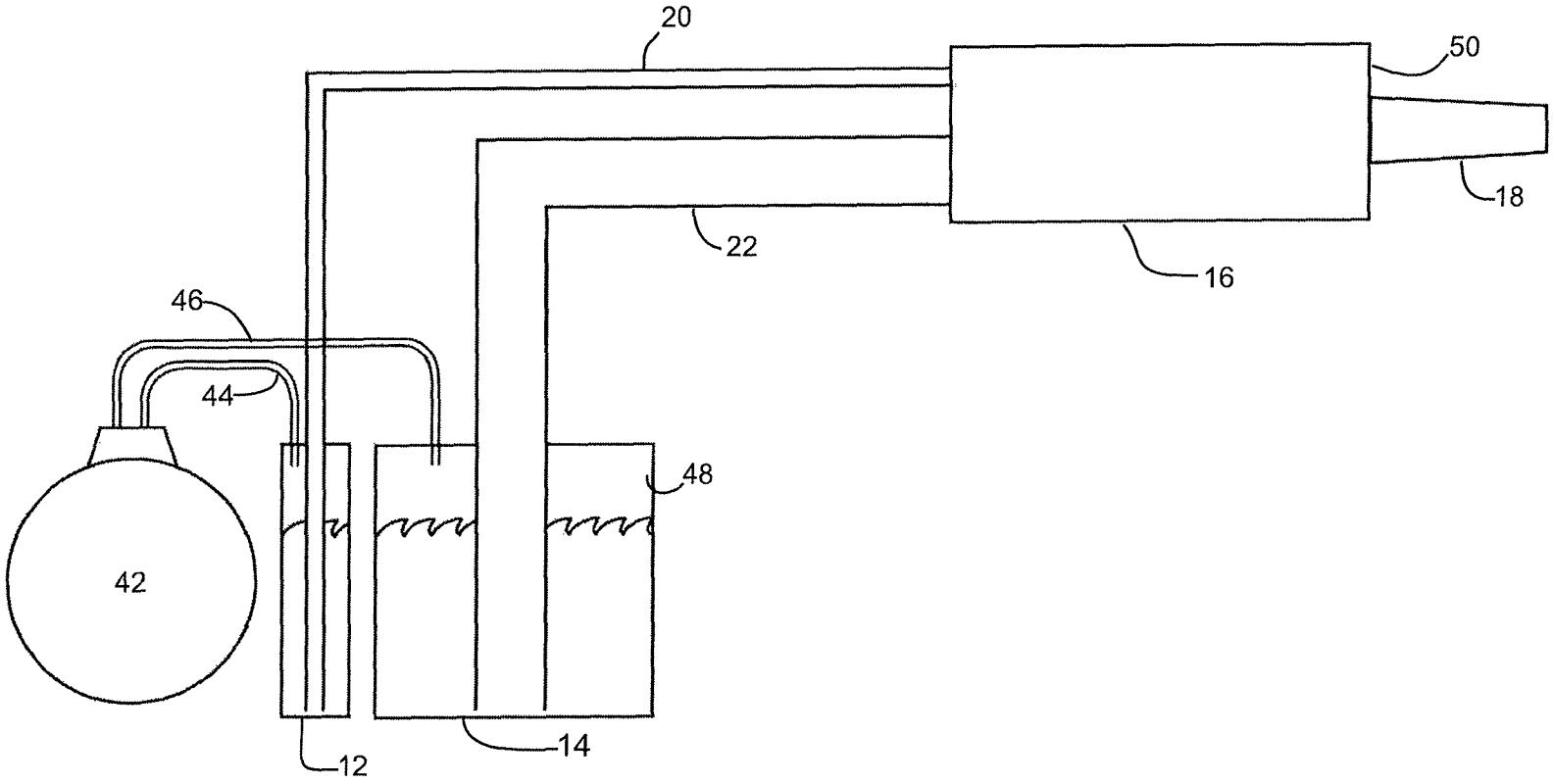
FIG. 3 is a schematic drawing of an alternate apparatus according to another embodiment.

In the alternate embodiment exemplified in FIG. 3, drive member 24 is not provided. Instead, the motive force to draw fluid through conduits 20 and 22 comprises pressure source 42. It will be appreciated that, in this embodiment, the relative amounts of the fluids drawn through conduits 20 and 22 may be adjusted by adjusting the pressure applied to containers 12, 14 and/or adjusting the internal diameter of conduits 20 and 22.

Figure 4:
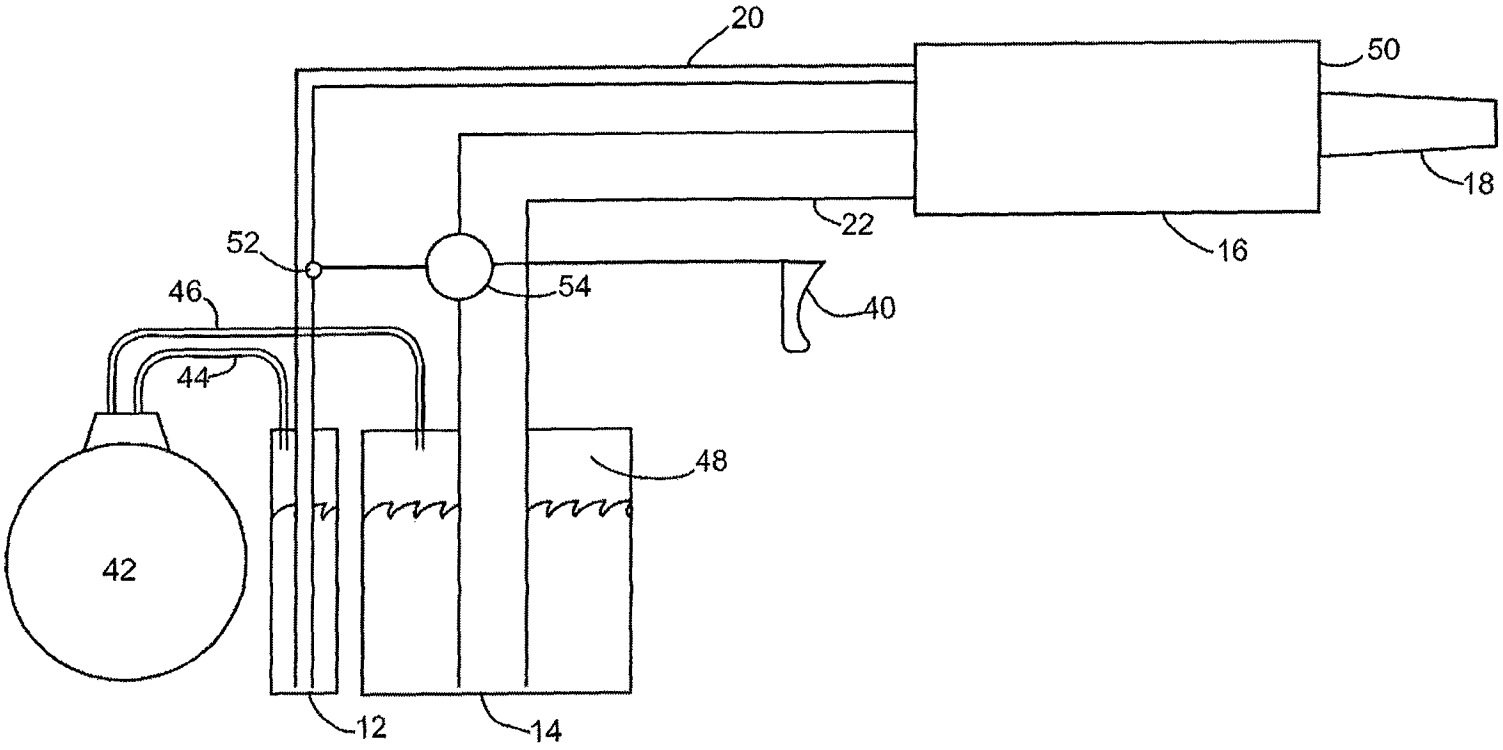
FIG. 4 is a schematic drawing of an alternate apparatus according to another embodiment.

As exemplified in FIG. 4, the flow of fluid may be controlled via first and second valves 52, 54 which may be provided in first and second conduits 20 and 22 respectively.

Valves 52, 54 may be actuated by actuator 40. Preferably, each of valves 52, 54 are opened by a single actuator 40 however, a different actuator 40 may be provided for each valve 52, 54. Actuator 40 may be drivingly connected to valves 52, 54 by any means known in the art and may utilize a mechanical linkage and/or electronic control (e.g. a solenoid). In one embodiment, valves 52, 54 are opened concurrently. Alternately, each of valves 52, 54 may be variably controllable so that, by adjusting the amount that valves 52 and 54 are opened, the amount of fluid drawn through conduits 20, 22 may be adjusted to provide, or assist in providing, the desired mixing ratio of the fluids in mixer 16. The valves 52 and 54 may apply a force to the outside of a flexible portion of conduits 20, 22 thereby preventing the materials being delivered from coming into contact with the mechanism thus preventing fouling of the mechanism.

As exemplified in FIG. 33, valves 52, 54 may comprise abutment members 138 that compress the outside of conduits 20, 22 and may be driven my motors 52' and 54'

Figure 5:
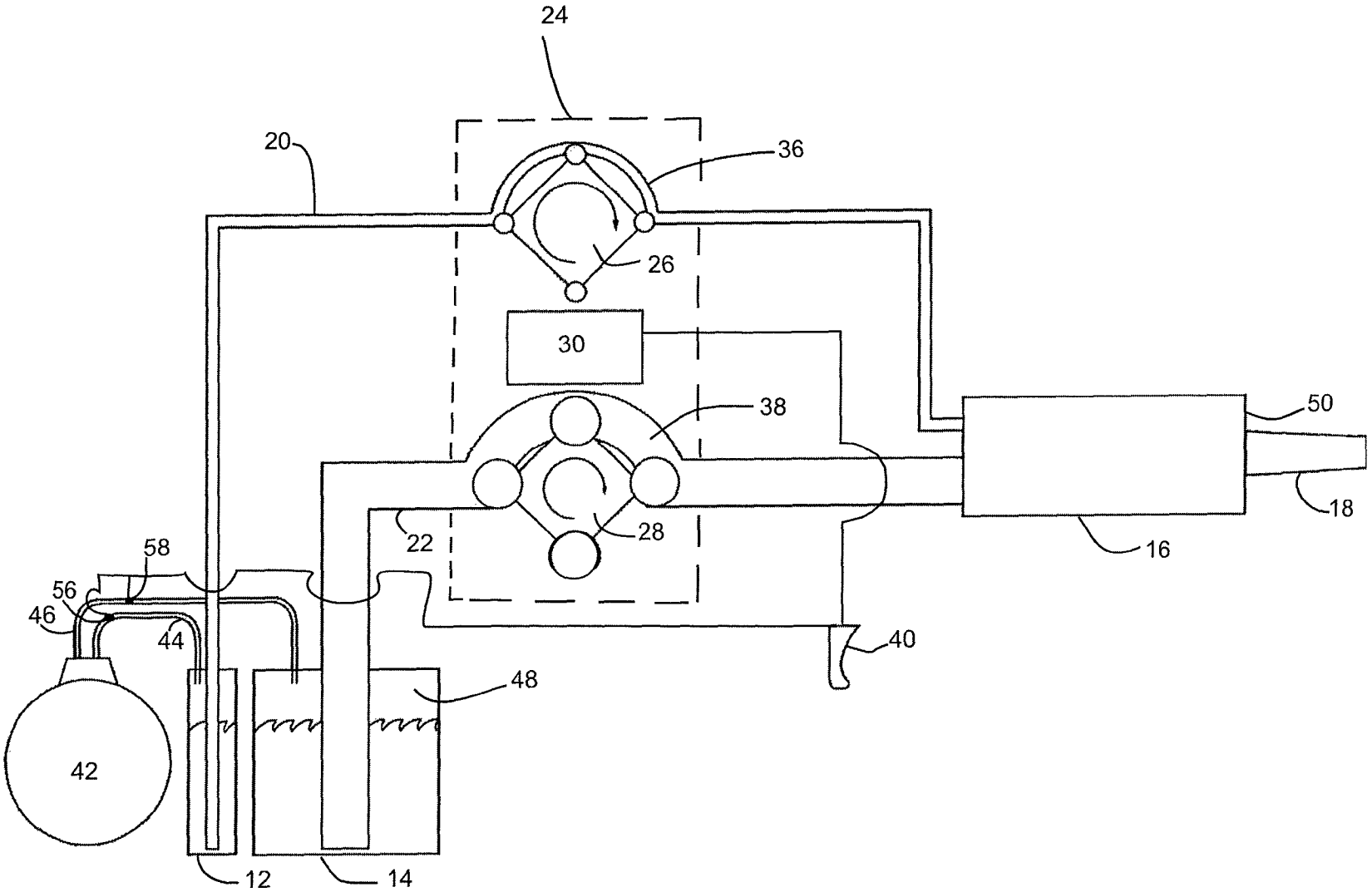
FIG. 5 is a schematic drawing of an alternate apparatus according to another embodiment.

As exemplified in the alternate embodiment of FIG. 5, trigger 40 may also control third and fourth valves 56, 58 which are provided in pressure lines 44 and 46. The valves 56 and 58 may apply a force to the outside of a flexible portion of pressure lines 44 and 46. Accordingly, instead of providing a valve in conduits 20 and 22, the flow of fluid through conduits 20 and 22 may be controlled by opening and closing pressure lines 44 and 46. It will be appreciated that third and fourth valves 56 and 58 may be utilized in alternate embodiments, including the embodiment of FIGS. 1-4. Further, a single actuator 40 may control the operation of all valves as well as drive member 24. Accordingly, control of the flow of fluid may be provided by one or more of the operating a valve in pressure lines 44, 46, operating a valve in conduits 20, 22 and drive member 24.

An alternate method which may be utilized to monitor or control the rate of delivery of fluid from containers 12 and 14 is weigh scale 140. As exemplified in FIG. 4, weigh scale 140 comprises a first compartment 142 for removably receiving container 12 and a second compartment 144 for removably receiving a container 14. Weigh scale 140 includes a base 146 and first and second sensors 148 and 150. Sensors 148 and 150 may be any sensors known in the art. Sensors 148 and 150 provide an output. The output of sensors 148, 150 may be provided to motor 30 of peristaltic pumps 26, 28. Accordingly, as fluid is removed from each container 12, 14, the weight of the containers will be reduced. Accordingly, weigh scale 140 may provide real time data about the amount of fluid left in containers 12, 14 to, e.g. motor 30 which drives peristaltic pump 26, 28. A processor or the like may also be included in the circuit. Accordingly, the processor may utilize the current weight of each container 12, 14 to determine if the fluids have been mixed in the correct proportion and to adjust the rate of one or both of the peristaltic pumps 26, 28 to ensure or assist in providing the correct ratio of fluids are delivered to the mixer 16. Alternately, or in addition, a flow meter 152 may be provided in one or both lines 20, 22. The flow meter may open or close conduits 20, 22, based upon the signal provided from weight scale 140, to assist in controlling, or to control, the rate at which fluid is delivered from each container to nozzle 16 and thereby control the mixing proportion of the fluids which are drawn from containers 12, 14.

If conduits 20 and 22 are flexible, or at least portion thereof are flexible, then a support structure 60 is preferably provided so as to control and manipulate nozzle 18. For example, as shown in FIG. 6, support structure 60 comprises a handgrip-shaped portion 62 which includes trigger 40. Preferably, in this embodiment, mixer 16 is provided on handgrip-shaped portion 62 and nozzle 18 is provided on mixer 16. Accordingly, a person may utilize support structure 60 to adjust the position of nozzle 18 so as to dispense the mixed fluid at a desired location. Conduits 20 and 22 may be of indefinite length and may extend from containers 12, 14 to support structure 60 (see for example FIG. 31). This may provide a suitable length of conduit so a person may move about in a building and apply the mixed compound at a desired location. It will be appreciated that if drive member 24 is not provided on support structure 60, then a control member (e.g., a wire or mechanical linkage) or the like may extend with conduits 20, 22 to drive member 24.

An alternate support structure 60 is shown in FIG. 7. As shown therein, support structure 60 comprises an elongate member which includes mixer 16 and an elongate nozzle 18.

In accordance with another aspect, apparatus 10 may be utilized to dispense a single fluid. Accordingly, as exemplified in FIG. 8, a mixer 16 need not be provided. Instead, a wand 66 or an elongate nozzle 18 as shown in FIG. 7 may be used in place of a mixer 16.

Figure 8:
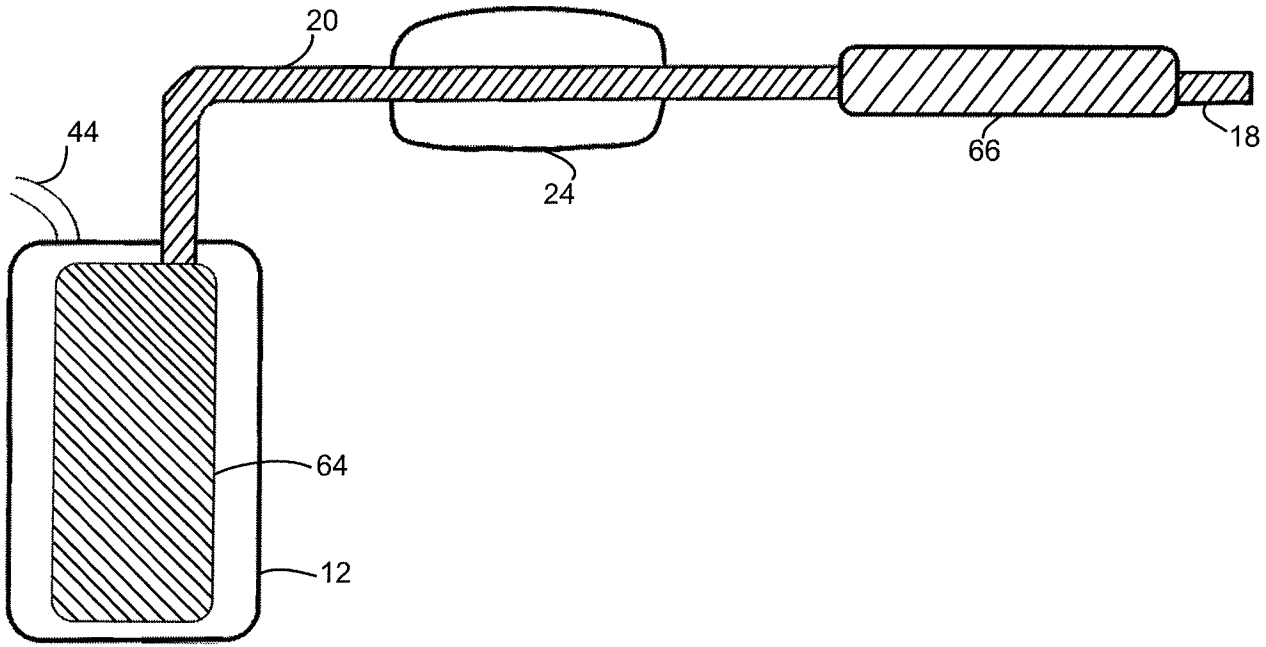
FIG. 8 is a schematic drawing of an alternate apparatus according to another embodiment.

Also exemplified in FIG. 8, a container 12 may be provided with a first flexible container 64 provided therein. Conduit 20 conveys fluid from container 64 to wand 66 and nozzle 18. Drive member 24 may be any of those previously disclosed herein. Pressure may be applied to container 12 by line 44 using any of the methods disclosed herein. Accordingly, for example, a peristaltic pump 26 may be utilized to draw or assist in drawing fluid, which may be pressurized or may be at atmospheric pressure, from container 12 and may be dispensed at nozzle 18.

Pressurizable container 12, 14 may be rigid. As exemplified in FIG. 1, pressurizable container 12, 14 has a liquid provided therein and the fluid is pressurized by providing a pressurizable fluid (preferably a gas) into a portion of container 12, 14, such as via line 44, 46. As exemplified in FIG. 1, a pressurizable fluid is provided into the headspace 48 so as to increase the pressure within container 12, 14, and thereby drive or assist in driving fluid from container 12, 14 out via conduits 20, 22.

Figure 9:
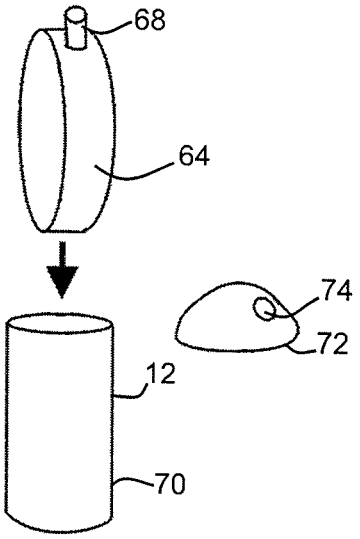
FIG. 9 is a schematic drawing of a pressurizable container according to one embodiment.

In an alternate embodiment as exemplified in FIGS. 8 and 9, container 12 may comprise a body portion 70 and an openable lid 72, all of which are preferably rigid. The container is openable, such as removing lid 72 or pivoting or removing lid 72 so as to enable a flexible container 64 to be placed in body portion 70. As exemplified, lid 72 is provided with a pressurized fluid inlet 74, which may be at the downstream end of, e.g., first pressure line 44. Flexible container 64 may be provided with an outlet 68 for the fluid therein. Outlet 68 may be in fluid communication with conduit 20. An opening is provided in container 12 so that outlet 68 may be connected to conduit 20. Accordingly, in operation, a pressurized source of fluid may be provided in communication with an internal cavity of container 12, such as via inlet 74. As the volume inside the container 12 is pressurized, pressure is applied directly on the outer surface of flexible container 74. This will apply pressure to the fluid in container 64 thereby providing a motive force to force the fluid in container 64 out of outlet 68.

It will be appreciated that the container 12 is preferably rigid, although part or all of the outer walls of container 12 may be flexible. It will be appreciated that if container 12 is rigid, all of the pressure which is applied to the interior of container 12 will apply motive force to all surfaces of container 64. It will also be appreciated that only part of container 64 may be flexible although it is preferred that all of container 64 may be flexible. Accordingly, all of the pressure which is applied in container 12 may be applied to all of the exterior surface of container 64 to thereby provide an efficient means of driving fluid of outlet 68.

It will be appreciated that each of containers 12, 14 may be similarly constructed or may be constructed utilizing different techniques disclosed herein.

Figure 10:
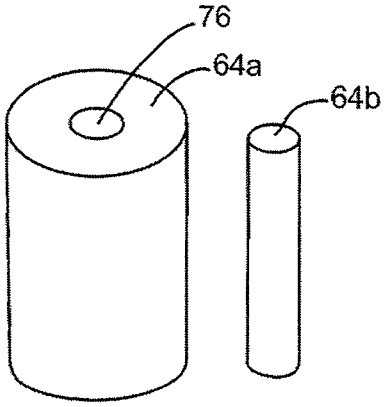
FIG. 10 is a perspective view of two fluid containers according to one embodiment.

Referring to FIG. 10, two flexible containers 64*a* and 64*b* may be provided. Container 64*a* may be provided in pressurizable container 14 and flexible container 64*b* may be provided in pressurizable container 12. It will be appreciated that containers 64*a*, 64*b* may have different volumes, if, for example, the fluids contained therein are to be mixed in different proportions. Accordingly, flexible containers 64*a*, 64*b* could be sized so that one the fluid therein is mixed in the appropriate portions, both are emptied at the same time.

Figure 11:
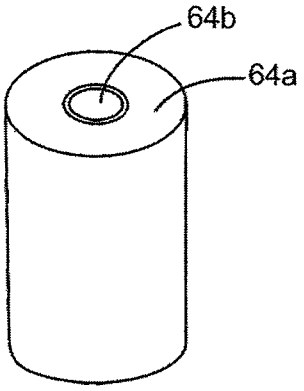
FIG. 11 is a perspective view of two fluid containers according to another embodiment.

In an alternate embodiment as exemplified in FIG. 11, container 64*b* may be positioned partially or wholly within container 64*a*, such as within cavity 76 (which may be an annular internal cavity) in container 64*a*. Accordingly, container 64*a*, 64*b*, may be provided within a single pressurizable container 12, 14. It will also be appreciated that a single pressurizable container 12, 14 may house two or more separate flexible containers 64. For example, as exemplified in FIG. 18, two flexible containers 64*a*, 64*b* may be provided as separate members in a single container 12. When the cavity 106 inside container 12 is pressurized via line 44, pressure is applied to each of containers 64*a* and 64*b* to dispense, or assist in dispensing, fluid into conduits 20, 22.

In an alternate embodiment, as exemplified in FIG. 19, it will be appreciated that a fluid to be utilized may be provided in a container 12, 14 which has an expandable member 108 (e.g., a balloon) therein. In such an embodiment, container 12 is preferably rigid. A pressurized source of fluid 42 may be provided via a pressure line 44 to an inlet of container 12 which is in communication with the expandable member 108 which is provided internally in container 12. Accordingly, when a pressurized fluid (e.g. air) is provided into the expandable member 108, the expandable member 108 expands thereby indirectly applying pressure to fluid in container 12 and driving fluid out of container 12 into conduit 20.

Figure 35:
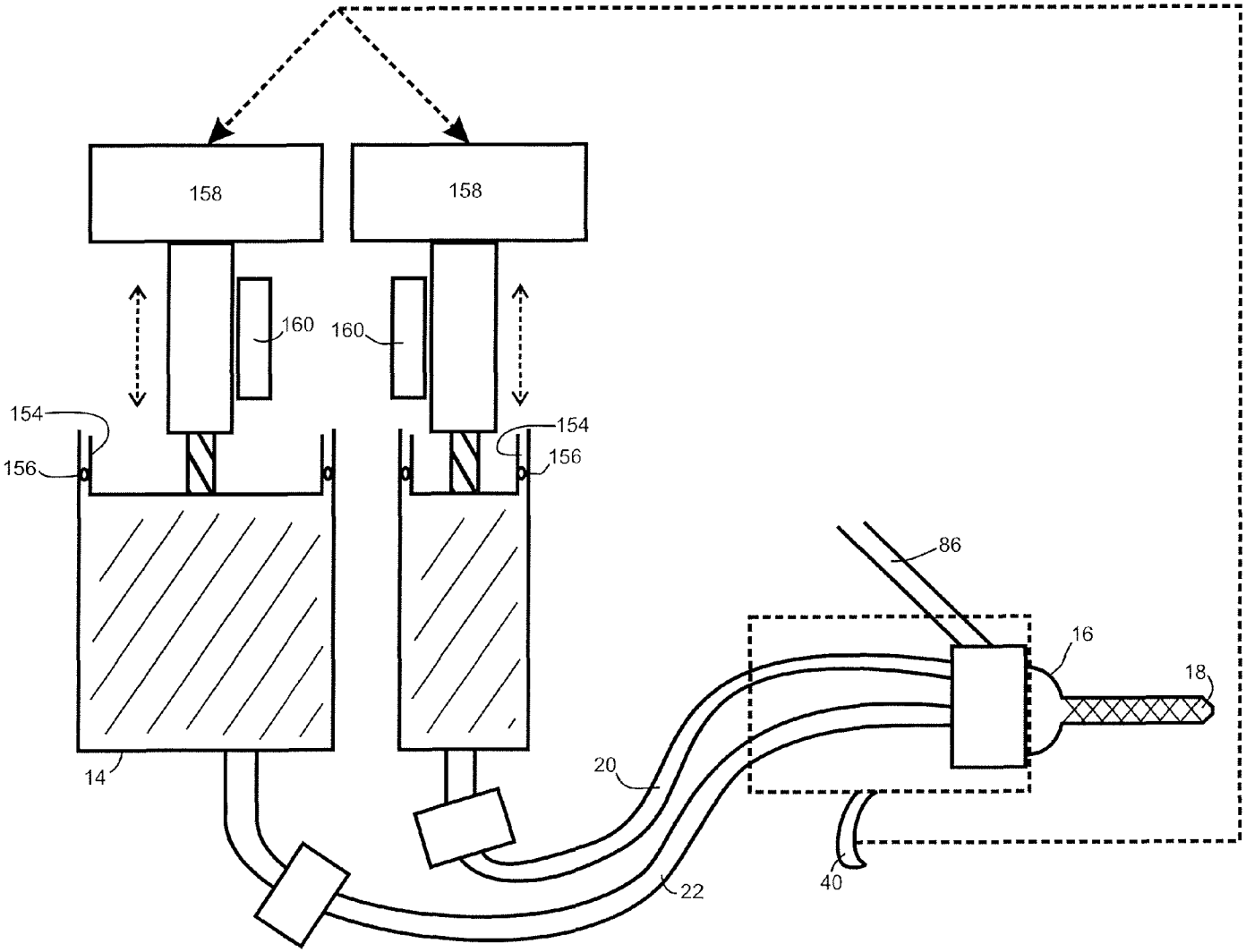
Figure 36:
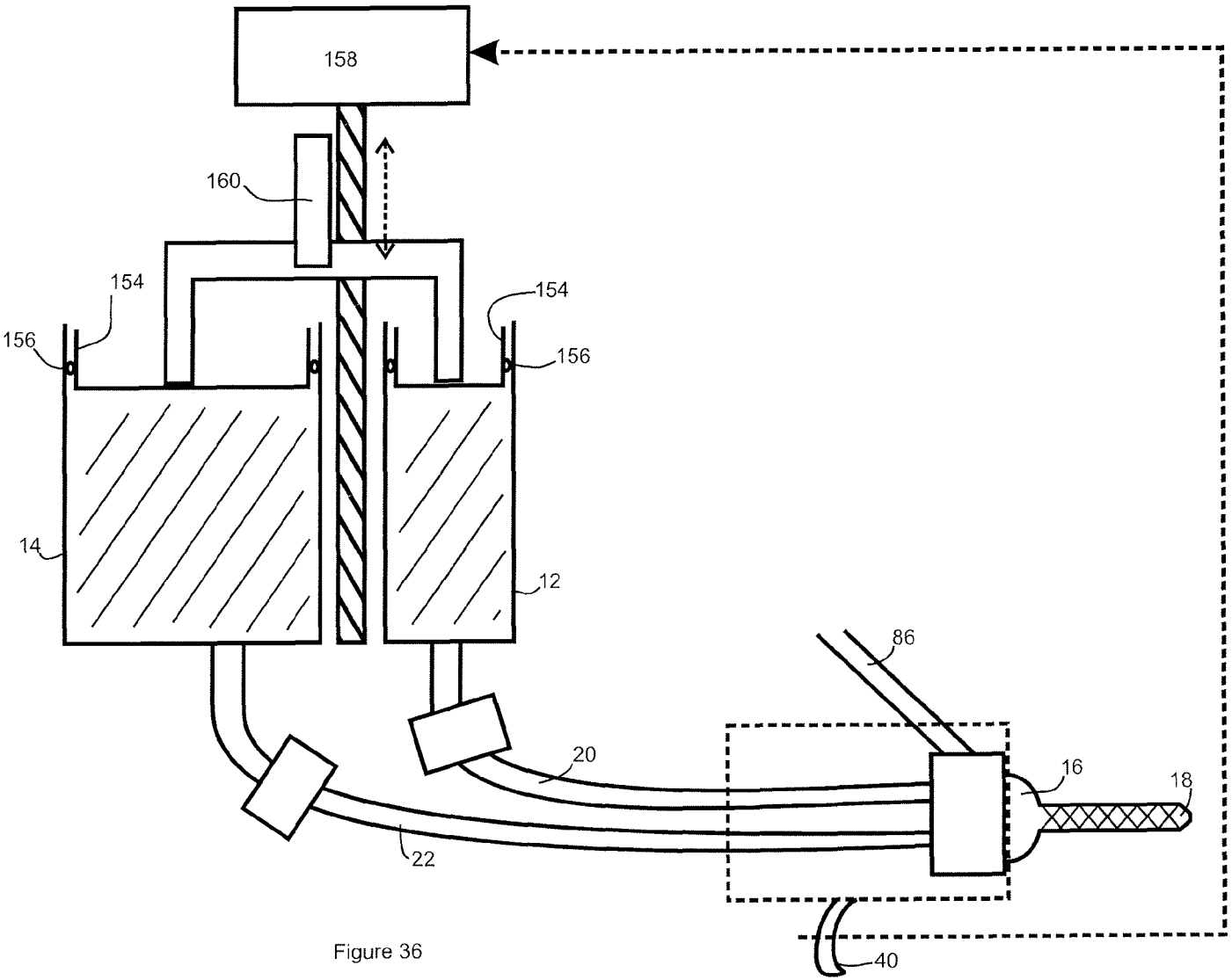

An alternate means of drawing fluid from containers 12 and 14 is shown in FIG. 35. As shown therein, a piston 154 is provided in an upper portion of each of containers 12, 14. A seal 156 is preferably provided between the outer wall of piston 154 and the inner wall of container 12, 14. Seal 156 is utilized to assist in preventing, or to prevent, fluid travelling upwardly past piston 154. Each piston 154 is driven by a motor, e.g. a stepper motor, which is actuated by, e.g. actuator 40. A position sensor 160 may be provided for monitoring the position of piston 154, and accordingly, may be utilized to control the rate of movement of each piston so as to assist in maintaining, or to maintain, delivery of the fluid in the desired mixing ratio. Alternately, position sensor 160 may be utilized to provide information as to the amount of fluid in each of containers 12, 14. FIG. 36 shows an alternate embodiment in which a single stepper motor is utilized in place of the stepper motors of FIG. 35.

An alternate delivery method is exemplified in FIG. 35. As shown therein, piston 154 is provided in container 12, 14 with optional seals 156. A position sensor 162 monitors the position of piston 154. In this embodiment, sensor 162 utilizes a wire or other member which provides a variable signal as the length of wire or member 168 is extended. Accordingly, as piston 154 extends further into container 12, 14, the length of wire or member 168 will increase. This increase in length will provide a change in the signal output by sensor 162. This change in signal may be utilized to control the rate of delivery of fluid from container 12, 14 and/or to provide a readout of the amount of fluid still in container 12, 14.

Figure 38:
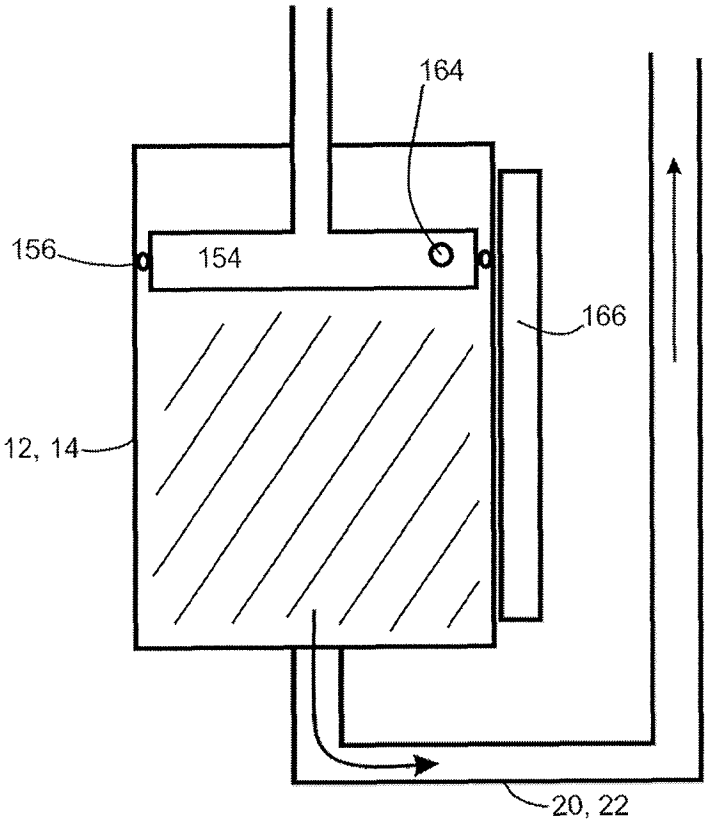
Figure 37:
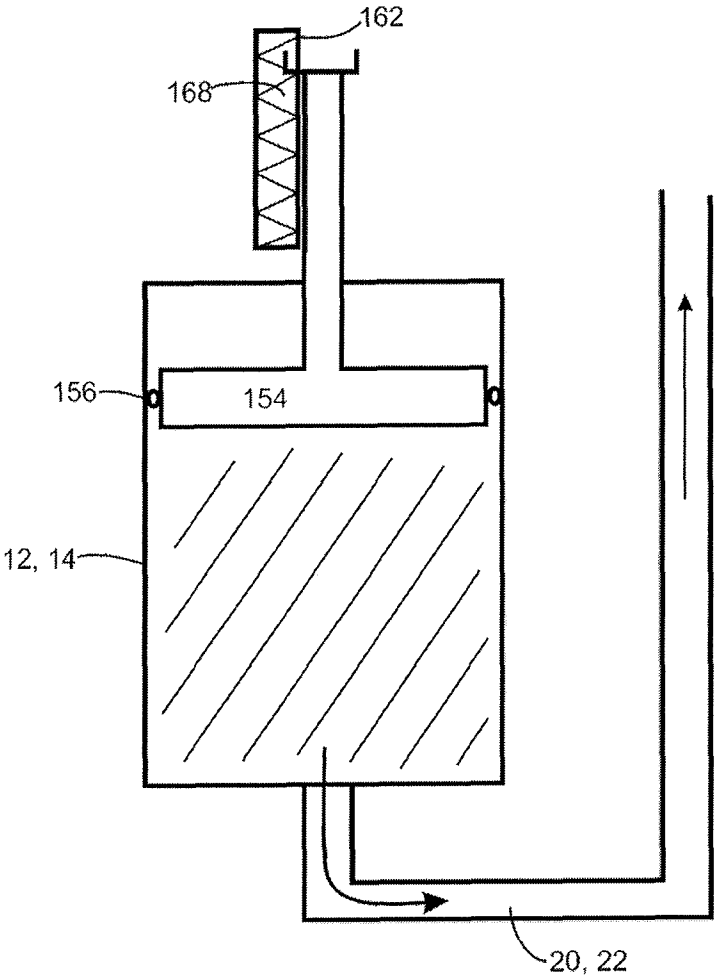

A further alternate means is shown in FIG. 38, as shown therein, one or more magnets 164 are provided in piston 154. Sensor 166 is provided on the exterior of container 12, 14 and monitors the position of magnet 164. Accordingly, the signal from sensor 166 may be utilized to control the rate of delivery of fluid from container 12, 14 and/or to provide a signal indicating the amount of fluid left in container 12, 14.

An advantage of any of these designs which use a collapsible container is that air is not introduced into the same space as the fluid as fluid is withdrawn. Thus, the introduction of air into the fluid in conduits 20, 22 may be reduced.

Figure 12:
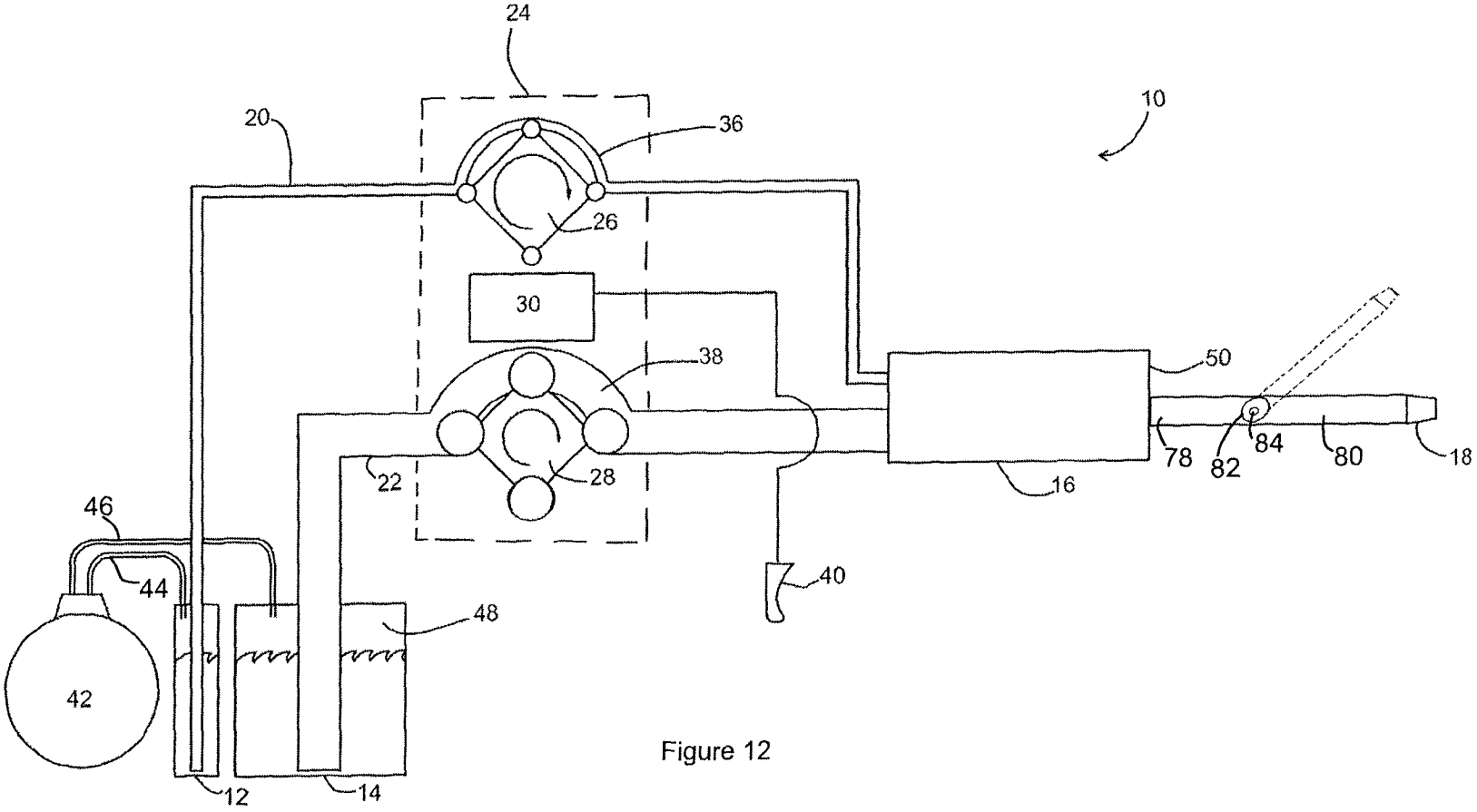
FIG. 12 is a schematic drawing of an alternate apparatus according to another embodiment; and, FIG. 13 is a schematic drawing of an alternate apparatus according to another embodiment.

In accordance with another embodiment, as exemplified in FIG. 12, the downstream portion of apparatus 10 may be articulated to move in two and, preferably, three dimensions. For example, as exemplified in FIG. 12, optional upstream extension wand 78 is provided downstream of mixer 16. Articulated joint 82 is provided upstream of downstream extension wand 80. Preferably, nozzle 18 is provided at the downstream end of downstream extension wand 80. Accordingly, the fluid, after being mixed in mixer 16, may travel through upstream extension wand 78, through articulated joint 82 into downstream extension wand 80 and be ejected via nozzle 18. The articulated joint may move along a single axis (e.g. it may be rotatable about an axis in a single direction with respect to downstream extension wand 80 (e.g., articulated joint 82 may move about an axis 84 that extends transverse to the longitudinal axis of upstream and downstream extension wand 78, 80). Alternately, articulated joint 82 may be operational in more than one plane. For example, it may be a spherical coupling member. Accordingly, downstream extension wand 80 may be movable in more than one plane with respect to upstream extension wand 78. For example, downstream extension wand 80 may be movable in two planes transverse to the longitudinal axis of upstream wand 78.

It will be appreciated that mixer 16 may be provided downstream from articulated joint 82. It will also be appreciated that nozzle 18 may be the outlet of downstream wand 80.

Alternately or in addition, as exemplified in FIG. 15, one or more cameras 96 or distance sensors may be provided on upstream and/or downstream extension wand 78, 80 and/or nozzle 18. The camera may be utilized to enable a person (e.g. the person holding support structure 60) to view the area that is being treated via apparatus 10. As exemplified in FIG. 15, the camera would permit a user to view joint 98, positioned at a juncture of wall 100 and floor 102, as, e.g., foamed insulation is deposited in joint 98. The distance sensor may also be utilized to advise a person the distance between, e.g., nozzle 18 and the surface to which the material is being applied. This may enable a person to maintain nozzle 18 at an appropriate distance from the area or to adjust the amount of blowing agent or air so as to ensure that the composition has a desired degree of aeration to the target surface. For example, a microcontroller may optionally adjust the flow rate and nozzle position relative to a joint to be sealed based upon the angular position of the joint to be sealed relative to the nozzle, the distance between the nozzle and to the joint to be sealed, and the relative velocity of the wand relative to the joint to be sealed.

Figure 13:
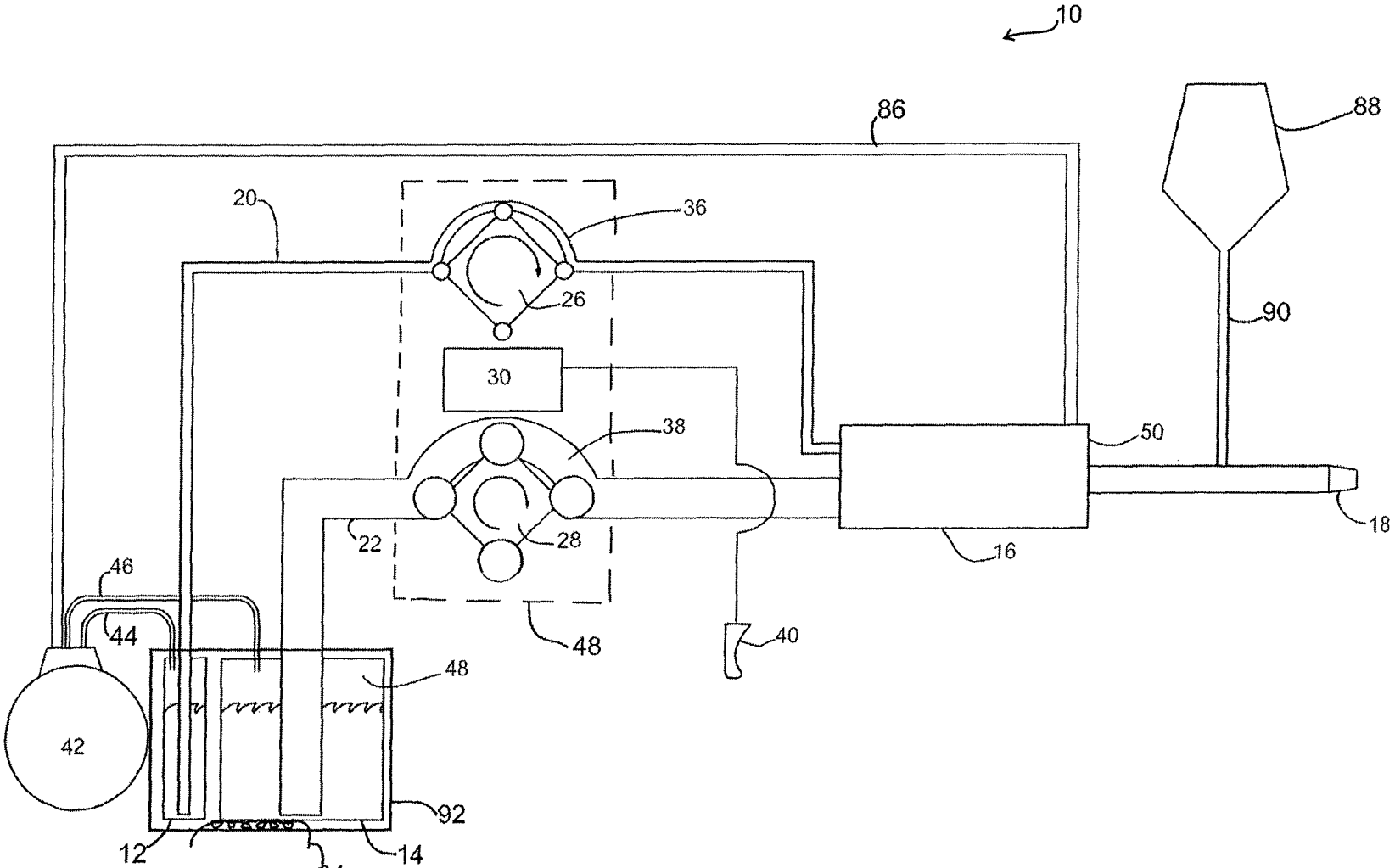

FIG. 13 exemplifies some additional optional elements which may be used with any of the embodiments disclosed herein. For example, as exemplified therein, containers 12, 14 are provided in a heating jacket 92 which is provided with a heating element 94. Accordingly, heat may be applied to the fluids in containers 12, 14 so as to reduce the viscosity thereof and improve the ease of flow thereof. Heating element 94 may be an electrical resistance heating element. Alternately, it may be a source of a heated fluid or any other heating means known in the art (e.g., a blower as exemplified in FIG. 33). The heat may be applied internally inside containers 12, 14 or by another means known in the art.

Figure 14:
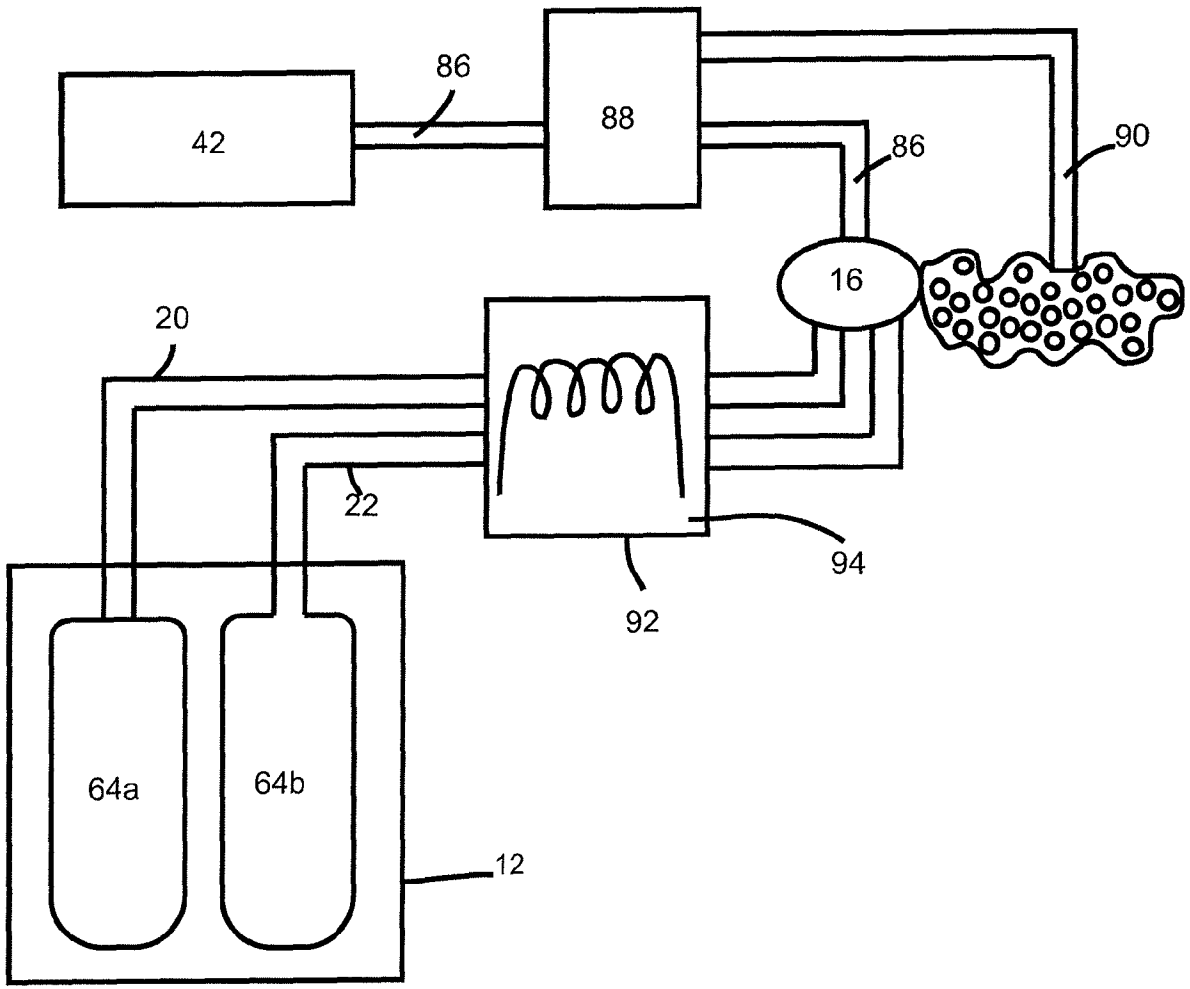
FIG. 14 is a schematic drawing of an alternate apparatus according to another embodiment.

Alternately, as exemplified in FIG. 14, heating jacket 92 (e.g., a flexible hollow conduit as exemplified in FIG. 32) which is provided with a heating element 94, may be provided to heat the fluid as it flows through conduits 20, 22.

Heating element 94 may utilize electrical resistive heating. For example, an electrical resistive heating element (e.g., a wire that may be provided as part of a tape) may extend longitudinally through jacket 92 or may be wrapped around one or more of conduits 20, 22. An advantage of heating the conduits is that the fluid may continue to flow despite the outside temperature and, further, the flow rate may be maintained as a relatively uniform rate regardless of the outside temperature. An advantage of electrical resistance heating is that a low uniform heat may be provided along the entire length of conduits 20, 22. Alternately, or in addition, heated air may be blown through heating jacket 92. In such an embodiment, the heated air may also be used to heat gun 110. Alternately, or in addition, gun 110 may be heated by other means, such as electrical resistance heating.

Air line 86 may be provided, preferably from pressure source 42, so as to deliver air to the mixed fluid. Pressure source 42 may be a cylinder of compressed gas, a compressor or any other means known in the art. It will be appreciated that air line 86 may be provided upstream, downstream (see FIG. 14) or to mixer 16 itself (see FIG. 13). The amount of air which is provided may be selected so as to provide the desired degree of aeration to the mixed fluid.

Alternately or in addition, air line 86 may be used to deliver gas, e.g., compressed or pressurized air) to mixer 16 and nozzle 18 to flow the fluid out of mixer 16 and nozzle 18 so as to prevent the mixed fluid from curing therein and therefore requiring the replacement thereof.

Alternately or in addition, air line 86 may be used to deliver gas, e.g., compressed or pressurized air) to a clearance nozzle 130 provided on, e.g., gun 110 (see for example FIGS. 26-29). Clearance nozzle may have an inlet 132 that is connectable in fluid communication with air line 86. The clearance nozzle may be used to clean a work surface before a fluid or mixed fluid is applied thereto. Accordingly, an actuator may be provided, e.g., on gun 110, to cause nozzle 130 to deliver a jet of gas as may be required. For example, the actuator may provide a signal to start a compressor. Alternately, it may open a valve 134 provided on or proximate clearance nozzle 130 (see for example FIG. 33). Accordingly, air line 86 may be pressurized and a jet of air delivered whenever valve 134 is opened. Clearance nozzle 130 maybe flexible (see FIG. 29) so that a jet of pressurized air may be directed at a work surface.

It will be appreciated that a different air line may be used to supply air to foam the mixture, to blow out mixer 16 and to provide the cleaning function.

Hopper 88 may be provided to deliver solid material via line 90 to the mixed fluid. It will be appreciated that line 90 may be in fluid communication with apparatus 10 upstream, downstream, or directly to mixer 16. Hopper 18 may be utilized to supply solid material, such as glass microspheres (solid or hollow), expanded polystyrene beads, glass fibers, aluminium micro spheres or other IR reflective materials or the like. Such material may be utilized to reduce the density of the mixed fluid and thereby increase the velocity at the exit from nozzle 18.

In any embodiment, an extension wand, such as upstream and/or downstream extension wands 78, 80 may be provided. The extension wand, which may be a telescoping or folding wand, may be 1 to 15 feet long, more preferably 2 to 10 feet long and most preferably 3 to 6 feet long. As exemplified in FIG. 17, upstream extension wand 78 comprises a telescoping wand having telescoping sections 104*a*, 104*b* and 104*c*.

FIGS. 20-24 exemplify a particular portable apparatus. As shown therein, caddy 112 is provided with first housing 170 and optional second or electrical housing 172. Housing 170 is provided with an openable portion, e.g. lid 174. When opened, cavities 176 are exposed in which containers 12, 14 may be removably seated. In addition, housing 170 preferably also houses the fluid transport means (e.g. peristaltic pumps 26, 28). Accordingly, the fluid containers 12, 14 and the peristaltic pumps 26, 28 may be provided in a closed container which is preferably thermally insulated.

An optional heater 178 may be provided inside housing 170 to maintain the temperature of the fluid. This is particularly useful during winter when the area in which the apparatus is utilized may be cold. A sensor, such as thermodisc 180, may be provided for monitoring the temperature in first housing 170. Accordingly, the temperature to be maintained in first housing 170 may be preset on a thermostat and the temperature may be automatically maintained during use of apparatus 10. Optionally, a blower 182 may be provided. Blower 182 may be used to ventilate and therefore cool the interior housing 170 if the temperature therein increases too much.

If fluid is withdrawn from containers 12, 14 by, or with the assistance of, pneumatic pressure, then housing 170 may be provided with a mount 184 to which a source of pressurized air and an optional regulator may be attached.

Optional second or electrical housing 172 may be provided at any particular location and is preferably provided immediately below a portion of housing 170. Electrical housing 170 houses motors 30 which drive, e.g. peristaltic pumps 126, 128. The power supply 186 for motors 30 may also be provided in housing 172. An advantage of providing the electronics and motor 30 in a separate housing is that the heat generated by the power supply and/or the motor may be separately contained and may not provide heat to container 170, which may otherwise overheat the fluid in containers 12, 14. As exemplified in FIG. 24, if second housing 172 is provided below a portion of housing 170, then the shaft from motor 30 may extent upwardly through an upper wall of second housing 170 and through a lower wall of first housing 170 so as to drive peristaltic pumps 26, 28.

It will be appreciated that an apparatus or a method in accordance with this disclosure may use one or more of the features disclosed herein. For example, an apparatus may use one or more of the external drive member, such as the peristaltic pump, the weigh scale to control delivery of fluid from containers 12, 14, the heating of the conduits from containers 12, 14 to the mixer 16 and/or heating the mixer 16, the use of collapsible containers using any one or more of the fluid delivery mechanisms disclosed herein, the use of backflow preventers as disclosed herein, the use of gas to clear a work surface and/or to clean out mixer 16, the use of flow lines of different diameters to control or assist in delivering the desired ratio of fluids to mixer 16 and the externally mounted power supply by utilizing a second housing 172.

The invention claimed is:

1. A mixing and dispensing apparatus comprising:

a) a flow path comprising at least two conduits, at least a portion of each of which is flexible, each conduit having an inlet end connectable to a source of fluid and an exit end;

b) at least one peristaltic pump operatively connected to the flexible portions;

c) the flow path further comprising a mixer downstream from the exit ends and in fluid communication therewith;

d) a discharge mechanism comprising a discharge nozzle downstream from the mixer and in fluid communication therewith whereby the discharge nozzle comprises a portion of the flow path and a hand grip portion wherein the hand grip portion is useable to direct the discharge nozzle at a target surface whereby the fluids, once mixed, may be applied to the target surface;

e) a first actuator operatively connected to the at least one peristaltic pump, and, f) a gas flow line exterior to the flow path and having an inlet end connectable with a source of pressurized gas and clearance nozzle at an outlet end, and a second actuator is operable to cause gas to flow through the gas flow line and out the clearance nozzle whereby the target surface may be cleaned before application of the mixed fluid.

2. The apparatus as claimed in claim 1 further comprising a handle coupled to the discharge mechanism, wherein the first actuator is provided proximate the handle.

3. The apparatus as claimed in claim 1 further comprising an inlet port connectable to a source of pressurized gas and in flow communication with the flow path, whereby, when a source of pressurized gas is attached to the inlet port, the pressurized gas is useable to assist in driving fluid through the flow path and out the discharge nozzle.

4. The apparatus as claimed in claim 1 further comprising a back flow preventer upstream of the mixer.

5. The apparatus as claimed in claim 1 further comprising a back flow preventer provided between the exit ends and the mixer.

6. The apparatus as claimed in claim 1 wherein the mixer is a static mixer.

7. The apparatus as claimed in claim 1 each of the at least two conduits has a different internal diameter.

8. The apparatus as claimed in claim 7 wherein the fluids are mixed in a particular ratio and the internal diameters are dimensioned based on the ratio in which the fluids are to be delivered to the mixer.

9. The apparatus as claimed in claim 1 wherein the peristaltic pump comprises a first driver to act externally on the flexible portion of one conduit of the at least two conduits and a second driver to act externally on the flexible portion of a second conduit of the at least two conduits, and the first and second drivers operate at different speeds.

10. The apparatus as claimed in claim 9 wherein the different speeds are selected so that the desired proportions of the fluids are delivered to the mixer.

11. The apparatus as claimed in claim 1 further comprising a heating member provided along at least a portion of the flow path.

12. The apparatus as claimed in claim 11 wherein the heating member comprises at least one of a heated passage through which a portion of the flow path extends and a resistive heating member.

13. The apparatus as claimed in claim 1 wherein the source of fluid comprises collapsible containers.

14. The apparatus as claimed in claim 1 wherein the peristaltic pump comprises a drive portion operatively connected to the flow path and a drive motor, the source of fluid comprises containers and the apparatus further comprises a first housing for receiving the containers, a portion of the flow path extending from the containers towards the mixer and the drive portion, the first housing has an openable lid.

15. The apparatus as claimed in claim 14 wherein the first housing is insulated.

16. The apparatus as claimed in claim 14 further comprising a second housing containing the drive motor.

17. The apparatus as claimed in claim 16 wherein the second housing is positioned with respect to the first housing such that the drive motor has a portion that extends from the second housing into the first housing and is drivingly engaged with the drive portion.

* * * * *